US007837300B2

(12) United States Patent
Mori

(10) Patent No.: US 7,837,300 B2
(45) Date of Patent: Nov. 23, 2010

(54) LIQUID JET HEAD, MANUFACTURING METHOD OF THE LIQUID JET HEAD, IMAGE FORMING DEVICE, NOZZLE MEMBER OF THE LIQUID JET HEAD, REPELLENT INK FILM FORMING METHOD, CARTRIDGE, AND LIQUID JET RECORDING DEVICE

(75) Inventor: Takashi Mori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1004 days.

(21) Appl. No.: 11/630,704

(22) PCT Filed: Jul. 14, 2005

(86) PCT No.: PCT/JP2005/013085

§ 371 (c)(1),
(2), (4) Date: Dec. 20, 2006

(87) PCT Pub. No.: WO2006/006682

PCT Pub. Date: Jan. 19, 2006

(65) Prior Publication Data

US 2007/0247492 A1 Oct. 25, 2007

(30) Foreign Application Priority Data

Jul. 15, 2004 (JP) ..... 2004-208386
Mar. 9, 2005 (JP) ..... 2005-064689
Jul. 8, 2005 (JP) ..... 2005-200426

(51) Int. Cl.
*B41J 2/135* (2006.01)

(52) U.S. Cl. ..... 347/45; 347/47

(58) Field of Classification Search ..... 347/29, 347/45–47, 64, 67, 71, 83
See application file for complete search history.

(56) References Cited

U.S. PATENT DOCUMENTS 6,109,728 A * 8/2000 Kakuda et al. ..... 347/45
6,561,624 B1 * 5/2003 Kikugawa et al.
7,267,426 B2 * 9/2007 Miyajima et al. ..... 347/45
2005/0054751 A1 * 3/2005 Namba et al.

FOREIGN PATENT DOCUMENTS

JP 4-336258 * 11/1992
JP 4-368854 * 12/1992
JP 7-314693 * 12/1995
JP 11-268278 * 10/1999
JP 2000-233500 * 8/2000
JP 2001-130000 * 5/2001
JP 2001-130126 * 5/2001
JP 2001-232799 * 8/2001
JP 2001-310471 * 11/2001

(Continued)

*Primary Examiner*—Thinh H Nguyen
(74) *Attorney, Agent, or Firm*—Cooper & Dunham LLP

(57) ABSTRACT

A liquid jet head includes a nozzle forming member having a water repellent layer formed on a liquid drop jet side surface of a nozzle base having a nozzle hole configured to jet a liquid drop of recording liquid; wherein the water repellent layer is made of silicon resin; an oxide layer is not provided between the liquid drop jet side surface of the nozzle base and the water repellent layer; and the oxide layer is provided on a nozzle hole internal wall surface of the nozzle base.

11 Claims, 18 Drawing Sheets

FOREIGN PATENT DOCUMENTS

| | | | |
|---|---|---|---|
| JP | 3379119 | * | 12/2002 |
| JP | 2003-19803 | * | 1/2003 |
| JP | 2003-72085 | * | 3/2003 |
| JP | 2003-72086 | * | 3/2003 |
| JP | 2003-266699 | * | 9/2003 |
| JP | 2003-335987 | * | 11/2003 |

* cited by examiner

FIG.11

| | OXIDE FILM | |
|---|---|---|
| | YES | NO |
| INITIAL STAGE | ○ (NO PEELING) | ○ (NO PEELING) |
| AFTER INK SOAKING | × (PEELING EXISTS) | ○ (NO PEELING) |

FIG.12

| | OXIDE FILM (WET FILM) | |
|---|---|---|
| | YES | NO |
| INK pH=3 | △ (LITTLE Ni ELUTION) | × (LARGE Ni ELUTION) |
| INK pH=9 | ○ (NO Ni ELUTION) | △ (LITTLE Ni ELUTION) |
| ADDING ELUTION PREVENTION AGENT | ○ (NO Ni ELUTION) | ○ (NO Ni ELUTION) |

LIQUID JET HEAD, MANUFACTURING METHOD OF THE LIQUID JET HEAD, IMAGE FORMING DEVICE, NOZZLE MEMBER OF THE LIQUID JET HEAD, REPELLENT INK FILM FORMING METHOD, CARTRIDGE, AND LIQUID JET RECORDING DEVICE

TECHNICAL FIELD

The present invention relates to liquid jet heads, manufacturing methods of the liquid jet heads, image forming devices, nozzle members of the liquid jet heads, repellent ink film forming methods, cartridges, and liquid jet recording devices.

BACKGROUND ART

An inkjet recording apparatus, for example, is known as an image forming apparatus such as a printer, facsimile, copier or a multiple function processing machine of the printer, facsimile, and copier. In the above-mentioned inkjet recording apparatus, while a recording medium is conveyed, a liquid drop of recording liquid (hereinafter "ink drop") is adhered to the recording medium by using a recording head (image forming part) having a liquid jet head configured to jet the liquid drop of the recording liquid, so that image forming such as recording or printing is performed. Hereinafter, the recording medium is called a paper or transferred material. However, there is no limitation of material for the paper or the transferred material.

In the meantime, since the liquid jet head jets a liquid drop for recording, the configuration and precision of a nozzle largely influence a jetting characteristic of an ink drop. In addition, it is known that a characteristic of a surface of a nozzle forming member forming a nozzle hole also influences the jetting characteristic of the ink drop.

For example, if ink is adhered to a periphery part of the nozzle hole of the surface of the nozzle forming member so that an uneven ink bank is formed, a problem occurs such that a jetting direction of the ink drop is changed; size unevenness of the ink drop is generated; and a flying speed of the ink drop becomes unstable.

Because of this, in the liquid jet head, generally, an ink repellent layer (film), a water repellent layer, or the like is formed on the liquid jet side surface.

For example, Japanese Laid-Open Patent Application Publication No. 2001-232799 discloses forming a fluoride water repellent film. Japanese Laid-Open Patent Application Publication No. 2003-72085 discloses a processing method for forming an ink repellent thin film by plasma-polymerizing silicon oil and a nozzle plate of a liquid jet head having a thin film such as ink repellent hexamethyldisiloxane by using this method.

Japanese Laid-Open Patent Application Publication No. 2003-72086 discloses that an ink repellent film such as a fluoride resin polymerization film or silicon resin polymerization film is formed and then the ink repellent film is heated in an inert atmosphere excluding oxygen and moisture so that a liquid material included in the ink repellent film is vaporized and the ink repellent film is cured.

Japanese Patent No. 3379119 discloses a method for forming a water repellent film wherein (1) a nozzle surface is soaked in liquid solution where a water repellent oil repellent material is dissolved while a state where gas is being released from a nozzle rear side to the nozzle surface is maintained; and then (2) the nozzle surface is taken out from the liquid solution and left as it is while the gas is released so that the water repellent oil repellent film is applied.

Japanese Patent No. 3379119 also discloses a method wherein (1) a nozzle plate of a liquid jet recording head is soaked in a liquid solution where a water repellent oil repellent material is dissolved so that a water repellent oil repellent film is formed on a nozzle plate surface; and then (2) ultraviolet rays are irradiated from a rear side of the nozzle plate or a plasma gas process is applied.

DISCLOSURE OF THE INVENTION

Problems to be Solved by the Invention

As discussed above, a method wherein eutectoid plating is applied to a surface of a metal nozzle plate and a heating process is applied so that a thin film of PTFE (polytetrafluoroethylene) is formed, a method wherein a fluoride water repellent agent is coated on a surface of resin nozzle plate (base), or the like is applied for manufacturing the jet head using fluoride resin as the water repellent layer.

In a case of the nozzle forming member having the fluoride resin as the water repellent layer, it is possible to achieve good water repellency or ink repellency in dye ink or pigment ink having an interfacial force exceeding 30 mN/m that is conventionally known.

However, according to experiments of the inventors of the present invention, it is found that sufficient water repellency or ink repellency cannot be obtained when ink having an interfacial force equal to or less than 30 mN/m, or ink where a fluoride chemical compound is added, is used.

On the other hand, as discussed above, in the jet head having the silicon resin film as the water repellent film, the water repellent film is formed by vacuum-depositing a liquid state silicon resin material or a plasma-polymerizing silicon oil.

However, in a case of the method forming the silicon resin film, a vacuum process is required at the time of deposition and therefore large size equipment is necessary so that cost is increased. In addition, in the vacuum deposition or plasma-polymerizing, since deposition time is long and a formed film is extremely thin, a defect such as a pin hole may be generated. Furthermore, in the method of vacuum deposition or plasma-polymerizing, it is difficult to make the silicon resin film thick. Therefore, it is difficult to implement the wiping of the nozzle surface (the liquid drop jet side surface) as a maintaining and recovering operation of the head or to provide sufficient durability against the ink.

In addition, as discussed in Japanese Patent No. 3379119, in the method wherein the nozzle plate is soaked in the liquid solution where the ink repellent agent is dissolved in the state where the gas is jetted from the nozzle hole so that the ink repellent layer is formed on the nozzle plate surface, since the nozzle plate is soaked in the liquid solution while the gas is jetted, air bubbles may be generated in the liquid solution. Hence, if the liquid solution is cured at normal temperature, it is necessary to leave the liquid solution in the air and it is difficult to keep maintaining a liquid state. Because of this, due to change of coefficient of viscosity of the liquid solution, the film thickness of the ink repellent cannot be controlled.

In addition, in the methods discussed in Japanese Laid-Open Patent Application Publications No. 2003-72085 and No. 2003-72086, configuration optimization of an edge part of the circumference of a nozzle hole, namely the vicinity of an edge end of the opening part, of the ink repellent film is not considered.

In other words, generally, the water repellent layer is formed by masking the nozzle hole or the water repellent layer covering the nozzle hole is removed after the water repellent layer is formed on the nozzle plate surface. In this case, as shown in FIG. 1(*a*), the ink repellent film of an edge part of the circumference of the nozzle hole has a configuration where the cross section at a plane surface perpendicular to a center line of the opening part is smaller as the plane area is further separated from the nozzle plate so that the configuration has a sharp edge. Here, FIG. 1 is a cross-sectional view of a related art liquid jet head nozzle plate having a structure where the sharp edge is provided in the vicinity of the edge end of the opening part.

In addition, in the method discussed in Japanese Laid-Open Patent Application No. 2003-72086 wherein the ultraviolet rays are irradiated from the rear side or the plasma gas process is applied after the water repellent oil repellent film is formed, the cross section at the opening part is smaller as the area is further separated from the nozzle plate so that the configuration has the sharp edge.

If the nozzle surface having the configuration shown in FIG. 1-(*a*) is wiped by a wiper 207 made of a material such as rubber, as shown in FIG. 1-(*b*), the wiper 207 comes in contact with the edge part so that the ink repellent film at the edge part may be peeled off.

In addition, as shown in FIG. 1-(*c*), at the time of supplying the ink, a meniscus P may be formed at the boundary part of the ink repellent film 201' and the nozzle plate 2 and a meniscus Q may be formed at the sharp edge part of the ink repellent film 201'. Because of this, unevenness of jet stability of the ink may be generated.

Because of this, the inventors of the present invention made a method for forming the water repellent layer wherein liquid state silicon resin is evenly applied on only a desirable part of a surface of the nozzle forming member by using the dispenser. However, in a case where ink flows by the silicon resin layer formed by this method, it is found that the silicon resin layer is peeled off with time from a part contacting the ink and the silicon resin layer may be peeled off by wiping to remove the ink adhered on the surface of the nozzle forming member or to form the meniscus.

Means for Solving the Problems

Accordingly, the inventors of the present invention studied the reason for the above-discussed peeling of the silicon resin layer and completed the present invention.

That is, one or more embodiments of the present invention provide a novel and useful liquid jet head, manufacturing method of the liquid jet head, image forming device, nozzle member of the liquid jet head, repellent ink film forming method, cartridge, and liquid jet recording device, in which one or more of the problems described above are eliminated.

More specifically, one or more embodiments of the present invention provide a liquid jet head having a nozzle member whereby adherence occurs between a silicon resin layer and a base, a manufacturing method of the liquid jet head, an image forming device, a nozzle member of the liquid jet head, a repellent ink film forming method, a cartridge, and a liquid jet recording device.

One aspect of the present invention may be to provide a liquid jet head, including a nozzle forming member having a water repellent layer formed on a liquid drop jet side surface of a nozzle base having a nozzle hole configured to jet a liquid drop of recording liquid; wherein the water repellent layer is made of silicon resin; an oxide layer is not provided between the liquid drop jet side surface of the nozzle base and the water repellent layer; and the oxide layer is provided on a nozzle hole internal wall surface of the nozzle base.

Another aspect of the present invention may be to provide a liquid jet head, including a nozzle forming member having a water repellent layer formed on a liquid drop jet side surface of a nozzle base having a nozzle hole configured to jet a liquid drop of recording liquid; wherein the water repellent layer is made of silicon resin; and an oxide layer provided between the liquid drop jet side surface of the nozzle base is thinner than an oxide layer provided on a nozzle hole internal wall surface of the nozzle base.

The nozzle base may be made of Ni. The recording liquid may include a fluoride chemical compound. The recording liquid may have a dynamic surface tension equal to or less than 30 mN/m and a ph in the range 8 through 11. An elution prevention agent may be added into the recording liquid.

Other aspect of the present invention may be to provide a manufacturing method of the above-mentioned liquid jet head, the manufacturing method including the step of: forming the water repellent layer made of the silicon resin in the nozzle base in the air.

The water repellent layer may be formed by applying the silicon resin to the nozzle base by a dispenser in a state where air is blown from an opposite side of the liquid drop jet side surface toward the liquid drop jet side surface side via the nozzle hole of the nozzle base. The water repellent layer made of the silicon resin may be formed on the nozzle base after an acid treatment, a plasma process, or an ultraviolet ray process is applied to the nozzle base so that a surface oxide layer is removed or a hydroxyl group substitution is made.

Other aspect of the present invention may be to provide a manufacturing method of the liquid jet, the manufacturing method including the step of: forming the water repellent layer made of the silicon resin on the nozzle base after an acid treatment, a plasma process, or an ultraviolet ray process is applied to the nozzle base so that a surface oxide layer is removed or a hydroxyl group substitution is made.

The water repellent layer may be formed by applying a normal temperature curing type liquid state silicon resin.

Other aspect of the present invention may be to provide an image forming device, including the liquid jet head configured to jet a liquid drop of recording liquid.

According to the liquid jet head of the embodiment of the present invention, the water repellent layer is made of the silicon resin; no oxide layer is provided between the liquid drop jet side surface of the nozzle base and the water repellent layer; and the oxide layer is provided on the nozzle hole internal wall surface of the nozzle base. Alternatively, the water repellent layer is made of the silicon resin; and the oxide layer provided between the liquid drop jet side surface of the nozzle base is thinner than the oxide layer provided on the nozzle hole internal wall surface of the nozzle base. Hence, the adherence between the silicon resin and the nozzle base is improved so that stable water repellency and stable liquid drop jet characteristic can be obtained.

According to the manufacturing method of the liquid jet head of the embodiment of the present invention, the water repellent layer made of the silicon resin is formed in the nozzle base in the air. Hence, it is possible to easily form the water repellent layer at low cost.

According to the manufacturing method of the liquid jet head of the embodiment of the present invention, the water repellent layer made of the silicon resin is formed in the nozzle base after the acid treatment, plasma process or ultraviolet ray process is applied to the nozzle base so that the surface oxide layer is removed or the hydroxyl group substitution is made.

According to the image forming device of the embodiment of the present invention, since the image forming device includes the liquid jet head of the embodiment of the present invention, water repelling capability is high and a good liquid drop jet characteristic is obtained. Therefore, it is possible to stably form a high quality image.

Other aspect of the present invention may be to provide a nozzle member of a liquid jet head, including an ink repellent film formed on a base surface where an opening part for liquid jetting is provided; wherein a cross section perpendicular to a center line of the opening part in the vicinity of the opening part of the ink repellent film is greater as being further separated from the base surface.

The vicinity of the opening part of the ink repellent film may have a curved surface configuration. A curvature radius of a curved line of the vicinity of the opening part of the ink repellent film in the cross section including the center line of the opening part may be equal to or greater than the thickness of the ink repellent film. A curved line in the cross section including the center line of the opening part from an edge end of the opening part to the vicinity of the opening part of the ink repellent film may be a substantially arch shaped curve; and a curvature radius of the arch shaped curve may be equal to or greater than the thickness of the ink repellent film. An angle formed by a tangent line passing through the opening edge end of the ink repellent film in the cross section including the center line of the opening part and a nozzle member surface including the edge part may be less than 90 degrees. The base of the liquid jet head may be made of metal or resin. In addition to the ink repellent film of the ink jet surface of the liquid jet head, the ink repellent film may be formed to a predetermined depth in the opening part internal wall. The thickness of the ink repellent film of the ink jet surface of the liquid jet head other than the vicinity of the opening part may be equal to or greater than 0.1 μm. The ink repellent film may have a surface roughness equal to or less than 0.2 μm.

Other aspect of the present invention may be to provide an ink repellent film forming method whereby an ink repellent film is formed on a base surface of a liquid jet head having an opening for liquid jetting, the ink repellent film forming method including the step of: applying a material of the ink repellent film by an applying part while gas is jetted from a side opposite to a liquid jet surface of a base of the liquid jet head.

Other aspect of the present invention may be to provide an ink repellent film forming method whereby an ink repellent film is formed on a base surface of a liquid jet head having an opening for liquid jet, the ink repellent film forming method including the step of: applying a material of the ink repellent film on a liquid jet surface of a base of the liquid jet head by an applying part; and jetting gas from a side opposite to the liquid jet surface of the base of the liquid jet head when the material enters the opening part to a predetermined depth.

An application capable width of the applying part may be substantially the same as an application subject width of the base surface of the liquid jet head; and an application may be completed by moving the applying part in a single direction in parallel one time. The applying part may be a dispenser; and the application may be implemented while a distance between the dispenser and the base of the liquid jet head is kept constant in advance. A material of the ink repellent film may be silicon resin or fluoride resin. The silicon resin may be a normal temperature curing type liquid state silicon resin or an elastomer; and the silicon resin may be applied on the base surface and left in the air at a normal temperature so that polymerizing-curing is made and an ink repellent film is formed. The silicon resin may be a normal temperature curing type liquid state silicon resin or an elastomer; and the silicon resin may be applied on the base surface and a heating process is applied so that an ink repellent film is formed. The silicon resin may be a normal temperature curing type liquid state silicon resin or an elastomer; and the silicon resin may be applied on the base surface and ultraviolet rays are irradiated for curing so that an ink repellent film is formed. The silicon resin may have a coefficient of viscosity equal to or less than 1000 cps (centipoises).

Other aspect of the present invention may be to provide a nozzle member of the liquid jet head, the liquid jet having the ink repellent film formed by the above-mentioned ink repellent film forming method.

Other aspect of the present invention may be to provide a liquid jet head, including the above-mentioned nozzle member. Other aspect of the present invention may be to provide a cartridge including the above-mentioned liquid jet head.

Other aspect of the present invention may be to provide a liquid jet recording device, including: the above-mentioned liquid jet head; wherein an image is formed by the liquid jet head. Ink to be used may be a liquid having a surface tension equal to or less than 70 mN/m. The ink may contain a fluoride group surface active agent. The ink may contain a pigment.

Effects of the Invention

Thus, one or more embodiments of the present invention provide a liquid jet head having a nozzle member whereby adherence between a silicon resin layer and a base occurs, a manufacturing method of the liquid jet head, an image forming device, the nozzle member of the liquid jet head which nozzle member has a configuration whereby it is difficult for a part from an edge end of the opening part of the repellent ink film formed in the surface of the base of the liquid jet head to the vicinity of the opening part to be peeled off resulting in a configuration good for jet stability, the repellent ink film forming method, the cartridge, and the liquid jet recording device.

BRIEF DESCRIPTION OF THE DRAWINGS

FIG. 11 is a table showing an example of experimental results of a relationship between existence of an oxide layer and peeling of a water repellant layer;

FIG. 12 is a table showing an example of experimental results of relationships among existence of a wet-proof film (oxide layer), elution of a nozzle base, and a characteristic of ink;

DESCRIPTION OF THE REFERENCE NUMERALS

Figure 1:
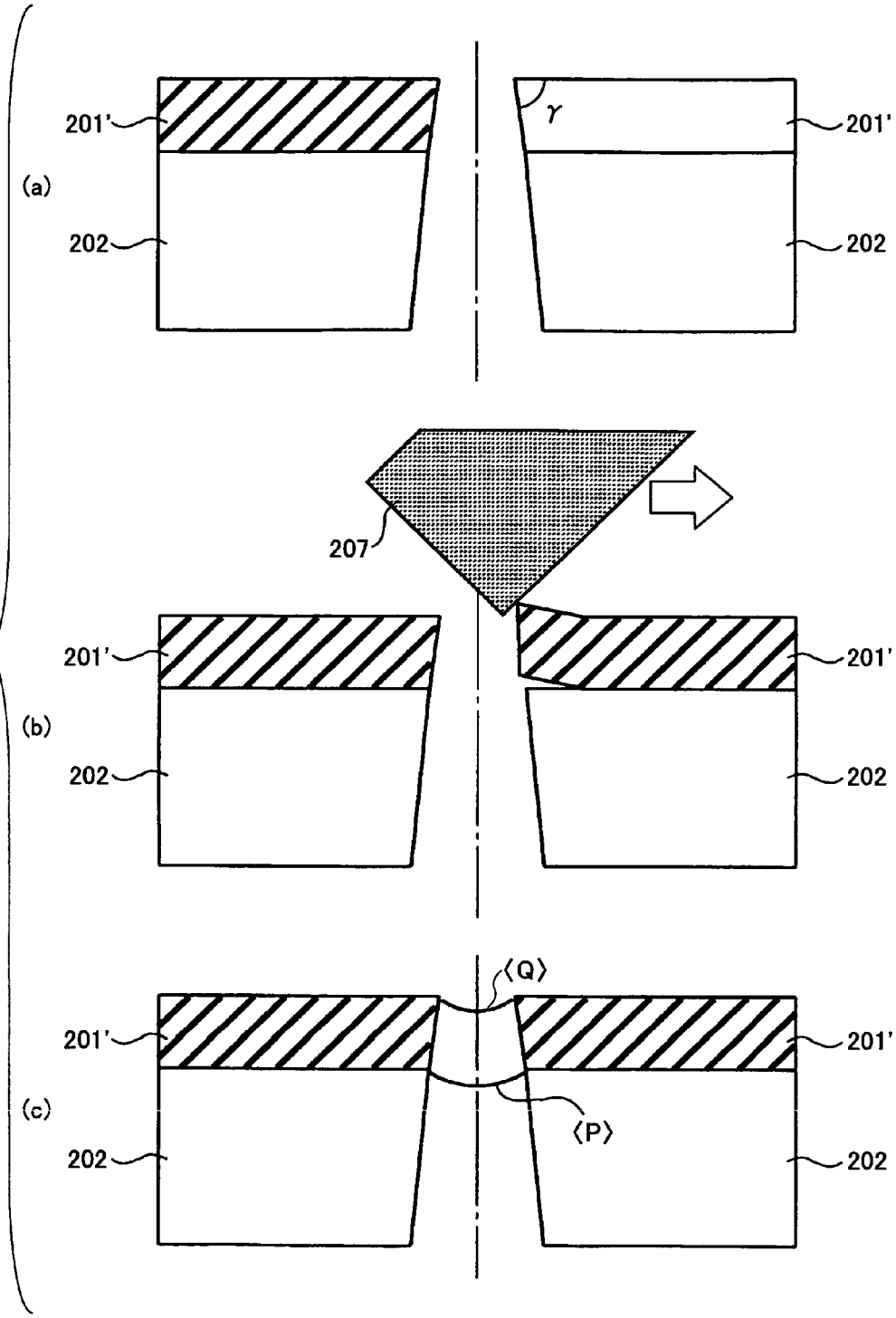
FIG. 1 is a cross-sectional view of a related art liquid jet head nozzle plate having a structure where a sharp edge is provided in the vicinity of an edge end of an opening part.

1 flow path plate
2 vibration plate
3 nozzle plate
4 nozzle
6 pressurizing liquid room
12 piezoelectric element
31 nozzle base
32 water repellent layer (silicon resin layer)
34 nozzle hole
35 oxide layer
36 natural oxide layer
50 dispenser
103 carriage
107 recording head
158 wiper blade
201 ink repellent film (silicon resin film, for example)
202 nozzle plate (made of Ni, for example)
203 ink
204 dispenser (syringe)
205 needle
206 gas
207 wiper

BEST MODE FOR CARRYING OUT THE INVENTION

A description of the present invention is now given, with reference to FIG. 2 through FIG. 22, including embodiments of the present invention.

First Embodiment of the Present Invention

Figure 2:
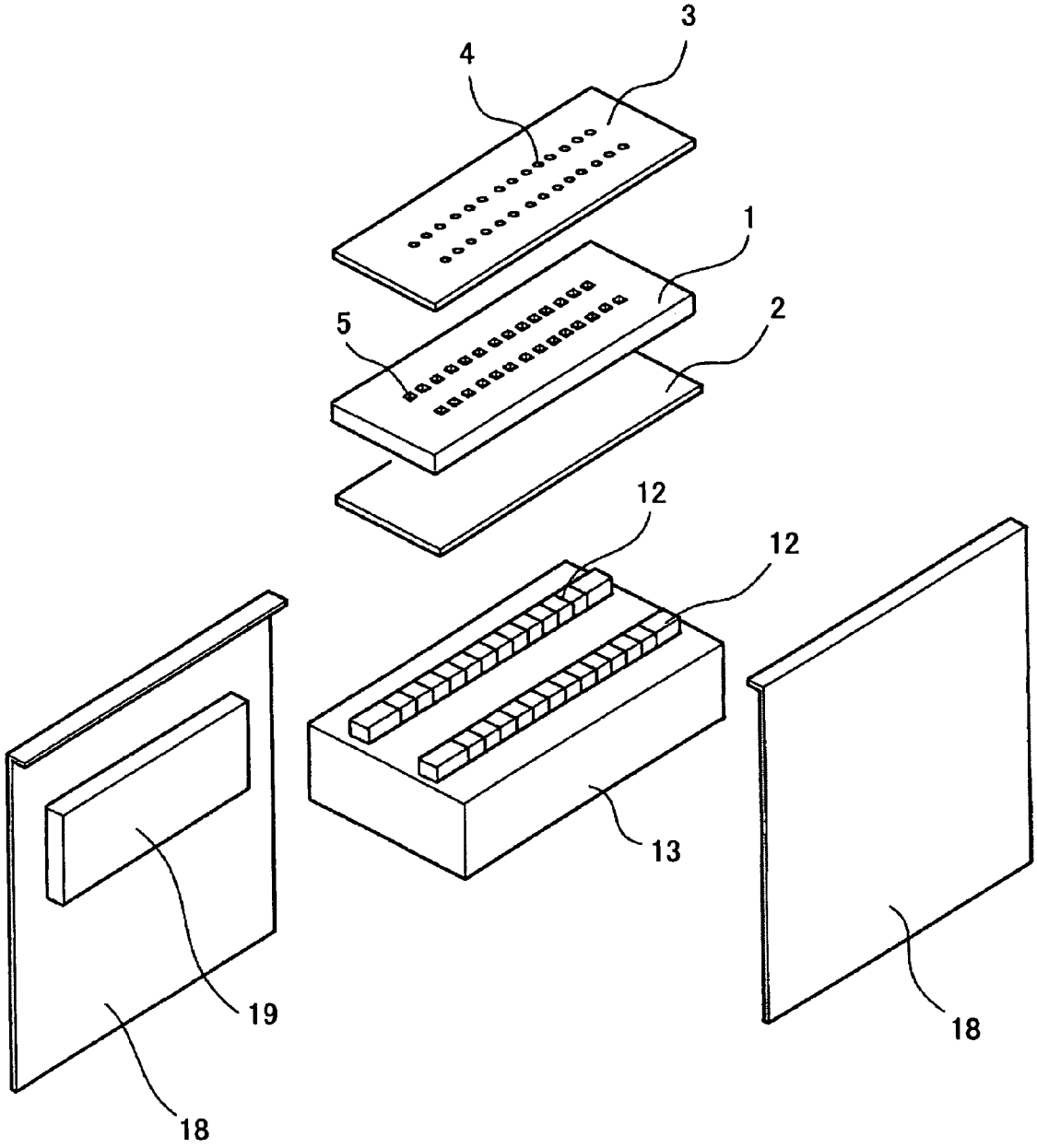
FIG. 2 is an exploded perspective view showing an example of a liquid jet head of the embodiment of the present invention.
Figure 3:
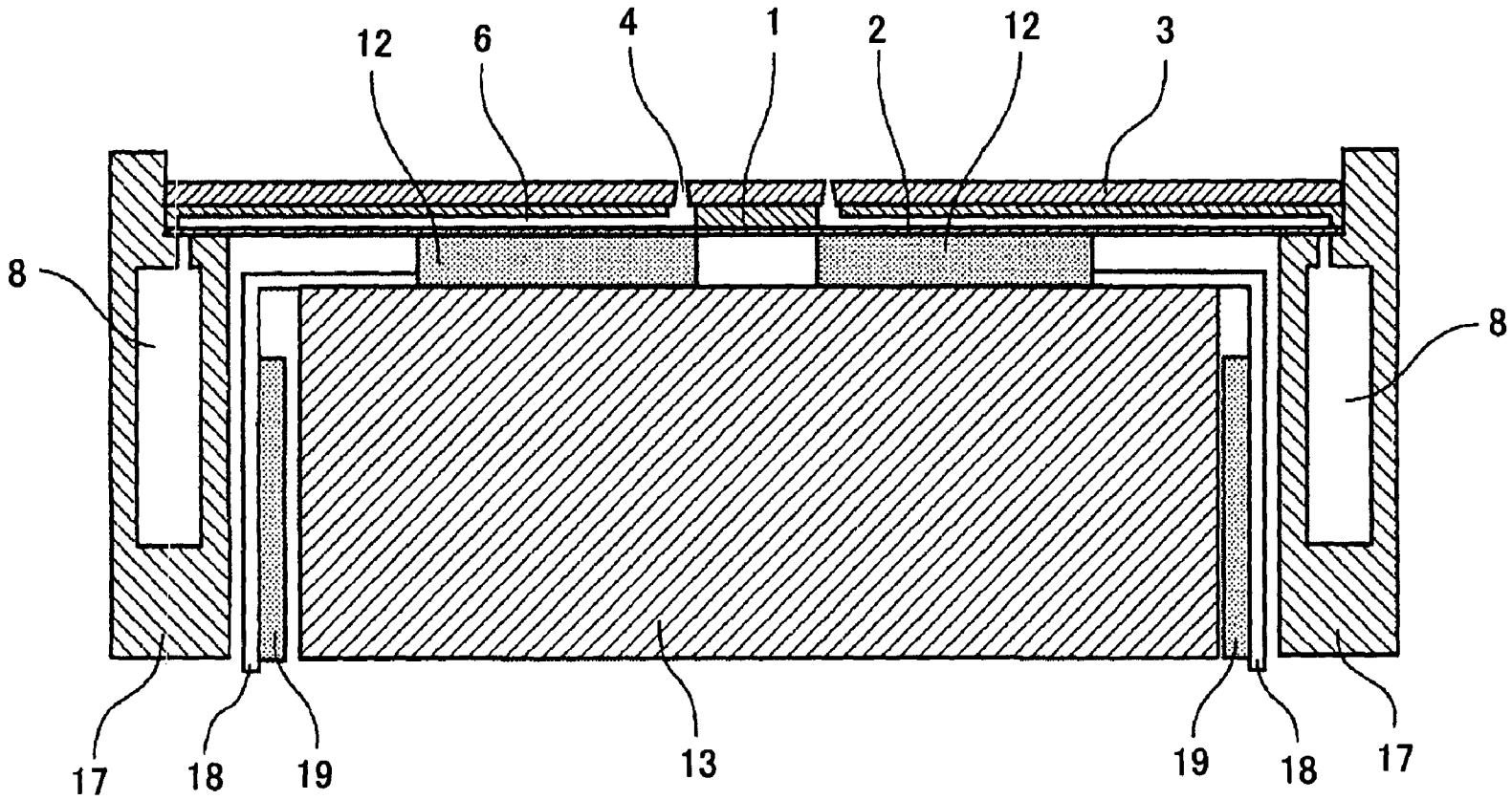
FIG. 3 is a cross-sectional view along a liquid room longitudinal direction of the liquid jet head of the embodiment of the present invention.
Figure 4:
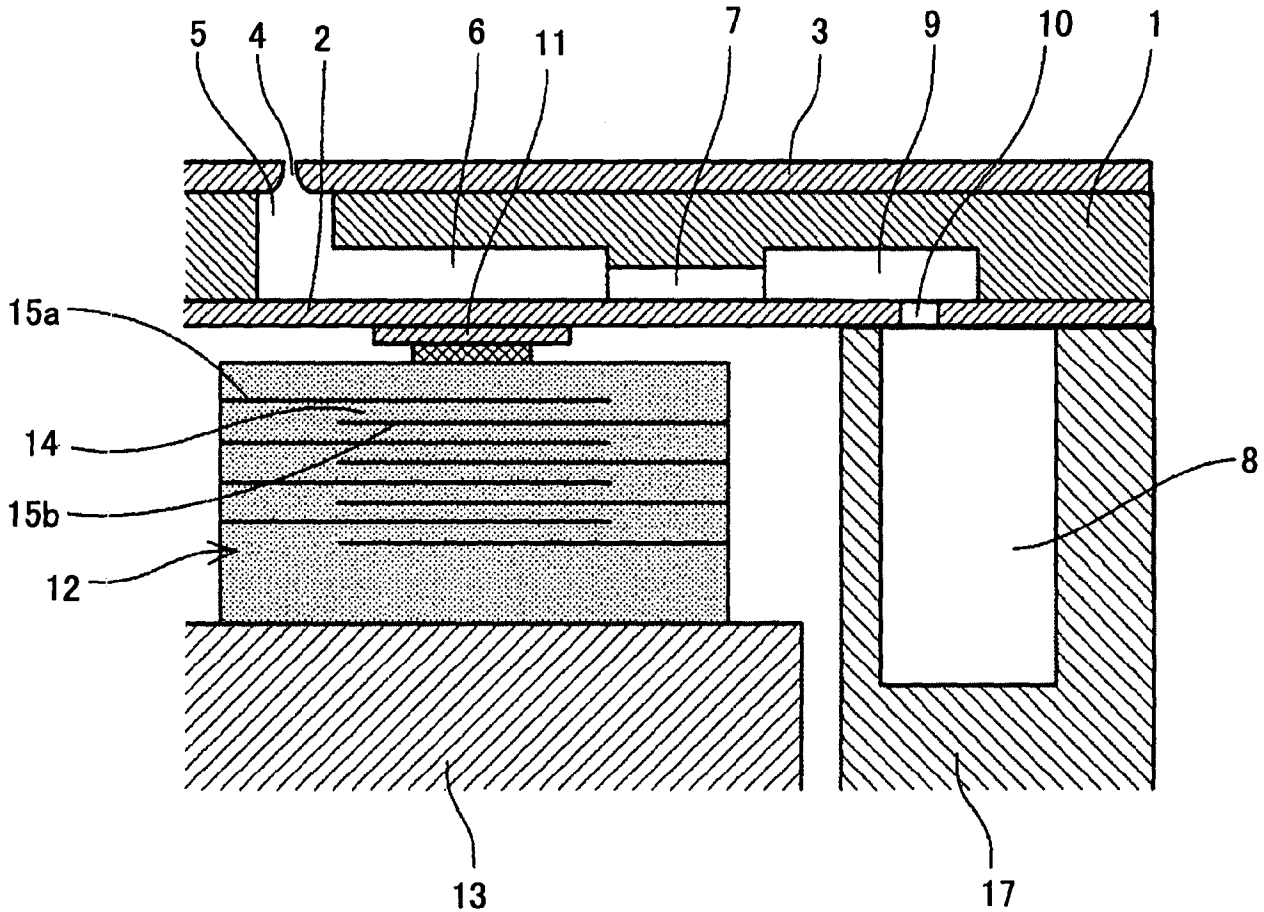
FIG. 4 is an enlarged partial view of FIG. 3.
Figure 5:
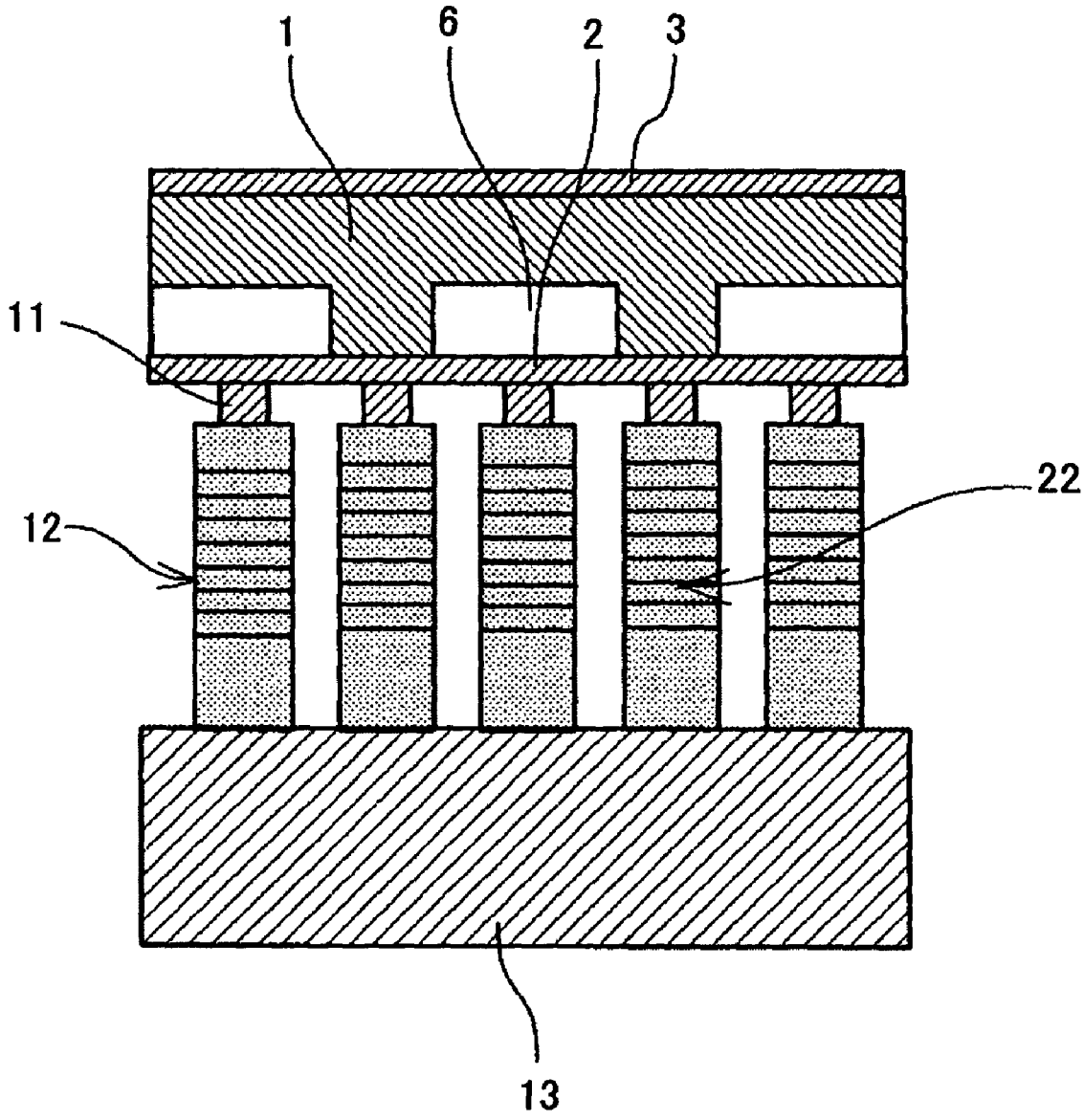
FIG. 5 is a cross-sectional view of a double pitch structure along a liquid room non-longitudinal direction of the liquid jet head of the embodiment of the present invention.
Figure 6:
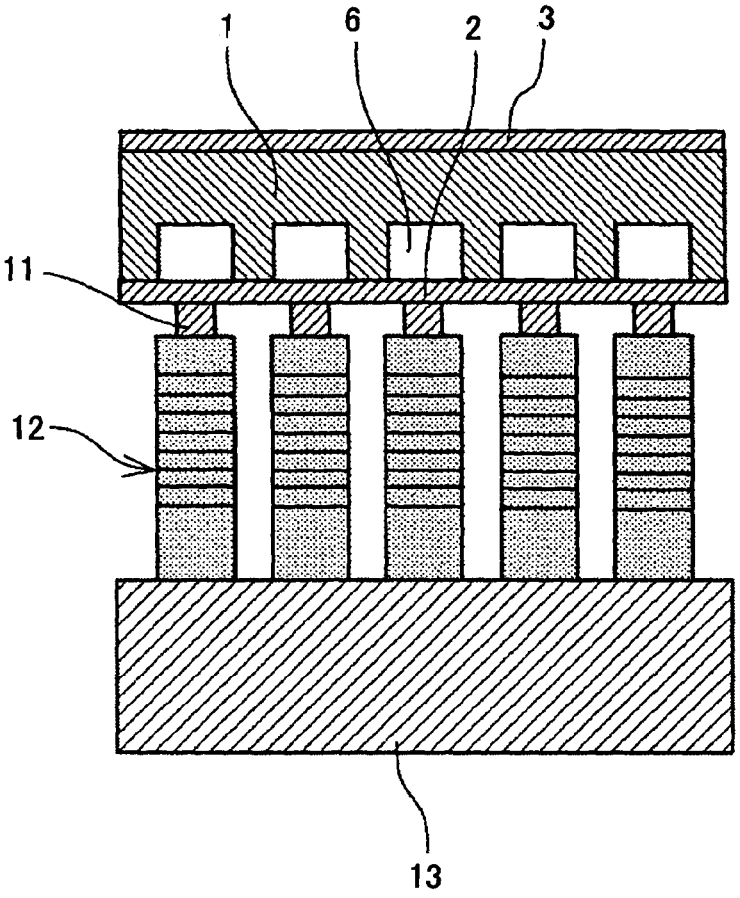
FIG. 6 is a cross-sectional view of a normal pitch structure along a liquid room non-longitudinal (perpendicular to the longitudinal) direction of the liquid jet head of the embodiment of the present invention.

A liquid jet head of a first embodiment of the present invention is discussed with reference to FIG. 2 through FIG. 6. Here, FIG. 2 is an exploded perspective view showing an example of the liquid jet head of the first embodiment of the present invention. FIG. 3 is a cross-sectional view along a liquid room longitudinal direction of the liquid jet head of the first embodiment of the present invention. FIG. 4 is an enlarged partial view of FIG. 3. FIG. 5 is a cross-sectional view of a double pitch structure along a liquid room non-longitudinal direction of the liquid jet head of the first embodiment of the present invention. FIG. 6 is a cross-sectional view of a normal pitch structure along a liquid room non-longitudinal direction of the liquid jet head of the first embodiment of the present invention.

The liquid jet head of the first embodiment of the present invention includes a flow path plate 1, a vibration plate 2, and a nozzle plate 3. The flow path plate 1 is formed by, for example, a single crystal silicon substrate. The vibration plate 2 is connected to a lower surface of the flow path plate 1. The nozzle plate 3 as a nozzle forming member is connected to an upper surface of the flow path plate 1. The flow path plate 1, the vibration plate 2, and the nozzle plate 3 form a pressurizing liquid room 6 where a nozzle 4 configured to jet an ink drop is connected via a connecting path 5, a fluid resistance part 7, and a connecting part 9 connecting to a liquid room 6 via the fluid resistance part 7. Recording liquid such as ink is supplied from a common liquid room 8 formed in a frame member 17 to the connecting part 9 via a supply opening 10 formed in the vibration plate 2.

Corresponding to each of the pressurizing liquid rooms 6, an upper end part of a stacked type piezoelectric element 12 as a pressure generation part is connected to an outside surface of the vibration plate 2 forming a wall surface of the liquid room 6, namely a surface side opposite to the liquid room 6, via a connection part 11 formed on the vibration plate 2. A lower end part of the stacked type piezoelectric element 12 is connected and fixed to a supporting board 13. The supporting board 13 may be divided for every line of the piezoelectric elements 12.

The piezoelectric element 12 has a structure where piezoelectric material layers 14 and internal electrodes 15*a* and 15*b* are mutually stacked. In this case, ink in the pressurizing liquid room 6 may be pressurized by using deformation in a d33 direction as a piezoelectric direction of the piezoelectric element 12. The ink in the pressurizing liquid room 6 may be pressurized by using deformation in a d31 direction as the piezoelectric direction of the piezoelectric element 12.

The circumferences of the flow path plate 1 and the vibration plate 2 are adhered and connected to the frame member 17 formed by injection molding by using, for example, epoxy resin or polyphenylene sulfide. Parts not shown of the frame member 17 and the supporting board are fixed to each other by an adhesive. The common liquid room 8 is formed in the frame member 17 along with a supply path (connection tube) not shown for supplying the recording liquid from outside to the common liquid room 8. This supply path (connection tube) is also connected to a recording liquid supply source such as a recording liquid cartridge (not shown).

In order to send a driving signal to the piezoelectric element 12, an FPC cable 18 is connected to the piezoelectric element 12 by solder connection, ACF (anisotropic conductive film) connection, or wire bonding. A driving circuit (driver IC) 19 configured to apply a driving waveform to each of the piezoelectric elements 12 is mounted on the FPC cable 18.

Here, anisotropic etching using alkaline etching liquid such as potassium hydroxide liquid solution (KOH) is applied to a single crystal silicon substrate, so that a groove forming part forming the connection path 5, a piercing hole being the pressurizing liquid room 6, the fluid resistance part 7, and the connection part 9 is formed in the flow path plate 1.

The vibration plate 2 is formed from a metal plate made of nickel (Ni) and manufactured by the electroforming method. This vibration plate 2 has a structure where a part corresponding to the pressurizing liquid room 6 is made thin for easy deformation and the connection part 11 for connecting the piezoelectric element 12 is centered on the pressurizing liquid room 6.

In a liquid room non-longitudinal direction, namely the arrangement direction of the nozzles 4, as shown in FIG. 5, a double pitch structure where the piezoelectric elements 12 and bar parts 12 are mutually arranged may be applied. Alternatively, as shown in FIG. 6, a normal pitch structure not having the bar parts 22 may be applied.

The nozzle plate 3 is formed by a metal plate made of nickel (Ni) and manufactured by the electroforming method. The nozzle plate 3 adhered and connected to the flow path plate 1 has the nozzles 4 having diameters of 10 through 35 μm corresponding to each of the pressurizing liquid rooms 6. A water repellent layer made of silicon resin is provided on a liquid drop jet side surface (surface in a jetting direction: a jet surface or a surface opposite to the liquid room 6 side) of the nozzle plate 3.

In the liquid jet head having the above-discussed structure, in a case where the liquid jet head is driven by, for example, a pushing method, driving pulse voltage of 20 through 50 V is selectively applied from a control part (not shown) to plural piezoelectric elements 2 corresponding to images to be recorded, so that the piezoelectric elements 12 where the pulse voltages are applied are deformed and thereby the vibration plate 2 is deformed in the nozzle plate 3 direction.

Based on the change of volume of the liquid room 6, liquid in the liquid room 6 is pressurized so that the liquid drop is jetted from the nozzle 4 of the nozzle plate 3. Accompanying the jetting of the liquid drop, the pressure in the liquid room 6 is decreased and a slight negative pressure is generated in the liquid room 6 by inertia of flow of the liquid. Under this state, application of voltage to the piezoelectric elements 12 is turned off so that the vibration plate 2 is returned to its original position and the liquid room 6 has its original configuration. Hence, further negative pressure is generated in the liquid room 6. At this time, the liquid entering from the liquid supply pipe connected to a liquid tank (not shown) fills the liquid room 6 and is jet from the nozzle 4 corresponding to the application of the driving pulse.

Figure 7:
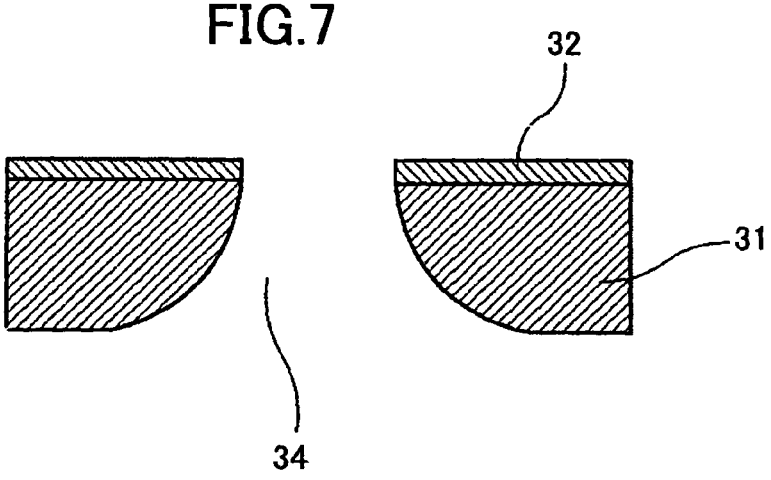
FIG. 7 is an enlarged partial cross-sectional view of the liquid jet head of the embodiment of the present invention.
Figure 8:
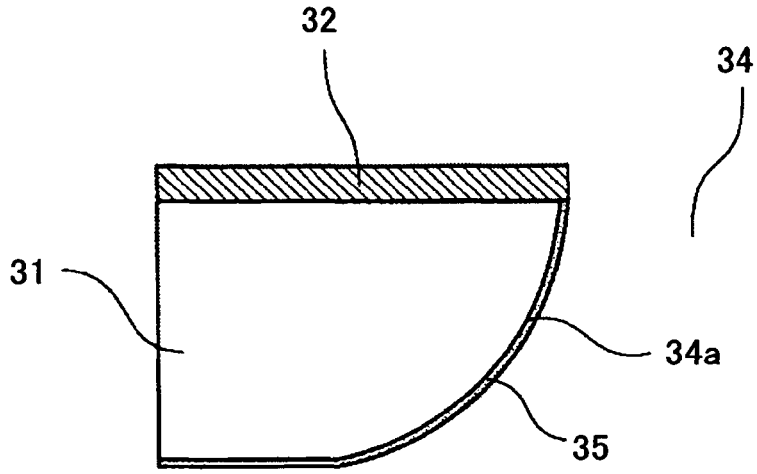
FIG. 8 is an enlarged view of FIG. 7.

Next, details of the nozzle plate 3 are discussed with reference to FIG. 7 and FIG. 8. Here, FIG. 7 is an enlarged partial cross-sectional view of a single nozzle part of the nozzle plate 3. FIG. 8 is an enlarged view of FIG. 7 (for the convenience of explanation, cross section hatching of a part of FIG. 8 is omitted).

In the nozzle plate 3, the water repellent layer 32 made of a silicon resin layer is directly formed on a jet surface side surface of the nozzle base 31 made of Ni metal plate where the nozzle hole 34 being the nozzle 4 is formed. A material forming the nozzle base 31 is not limited to the Ni metal plate. However, the nozzle base made of a metal material is effective for the embodiment of the present invention.

When the thickness of the silicon resin layer (water repellent layer 32) is, for example, approximately 0.1 μm through 10 μm, it is possible to secure water repellency and wiping resistance and deposition can be easily made. It is preferable that the surface roughness Ra of the silicon resin layer (water repellent layer 32) be equal to or less than 0.2 from the view point of obtaining good water repellency. In addition, by using a normal temperature curing type liquid state silicon resin as silicon resin for forming the water repellent layer 32, it is possible to apply a large amount of the silicon resin in the air. Especially, it is preferable to use liquid silicon resin accompanied by hydrolytic action.

In this nozzle plate 3, as shown in FIG. 8, there is no oxide layer between the nozzle base 31 and the water repellent layer 32. The silicon resin film having the above-mentioned thickness is formed on the surface of the nozzle base 31 and the oxide layer 35 is formed on the wall surface 34*a* of the nozzle hole 34 of the nozzle base 31. The oxide layer 35 may be a natural oxide layer or an oxide layer as a wet-proof film separately formed for improving the wet-proofing of the nozzle base 31.

In this case, for example, if the oxide layer as the wet-proofing film is formed on the surface of the nozzle base 31, the oxide layer (wet-proofing film) 35 is formed on the entirety of the surface of the nozzle base 31 by the oxidization process, and then the oxide layer on the surface of the jet surface side of the nozzle base 31 is removed. At this time, by not only simply removing the oxide layer but also, as discussed below, applying an the acid treatment, plasma process or ultraviolet ray process to the nozzle base 31 so that the surface oxide layer is removed or a hydroxyl group substitution is made, and then applying the silicon resin on the nozzle base 31 so that the water repellent layer is formed, it is possible to improve the adherence between the silicon resin layer 32 and the nozzle base 31. In addition, in a case where the natural oxide layer formed on the surface of the nozzle base 31 is removed, it is preferable to apply the acid treatment.

Thus, since there is no oxide layer between the nozzle base 31 of the nozzle plate 3 and the silicon resin layer being the water repellent layer 32, adherence strength between the surface of the jet surface side of the nozzle base 31 and the water repellent layer 32 being the silicon resin layer is improved. Hence, even if the water repellent layer 32 is formed by applying the silicon resin in the air, sufficient adherence strength between the surface of the jet surface side of the nozzle base 31 and the water repellent layer 32 being the silicon resin layer is obtained and stable water repellency can be maintained. In other words, since there is no oxide layer between the nozzle base 31 of the nozzle plate 3 and the silicon resin layer being the water repellent layer 32, the silicon resin is applied in the air so that the water repellent layer is formed and therefore the water repellent layer can be easily formed and the manufacturing cost of the liquid jet head can be reduced.

Next, another example of the nozzle plate 3 of the liquid jet head is discussed with reference to FIG. 9. Here, FIG. 9 is an enlarged partial cross-sectional view of another example of the liquid jet head of the embodiment of the present invention.

Figure 9:
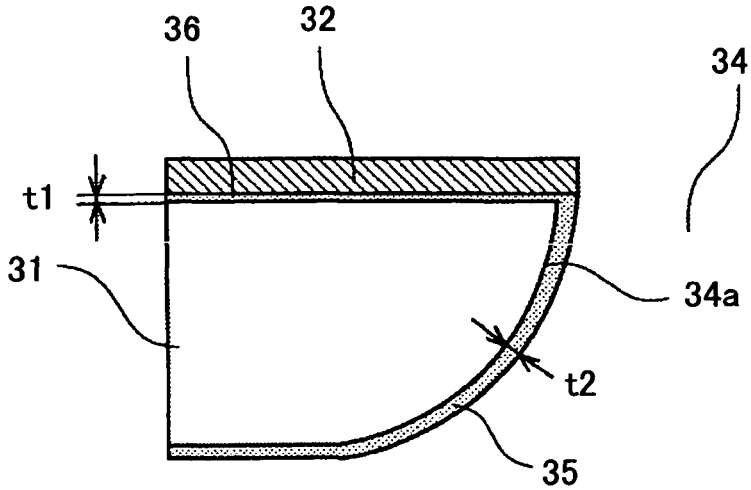
FIG. 9 is an enlarged partial cross-sectional view of another example of the liquid jet head of the embodiment of the present invention.

In the nozzle plate 3 shown in FIG. 9, the water repellent layer 32 made of the silicon resin layer is formed on the jet surface side surface of the nozzle base 31 made of Ni metal plate where the nozzle hole 34 being the nozzle 4 is formed.

Furthermore, in the nozzle plate 3 shown in FIG. 9, the natural oxide layer 36 remains between the nozzle base 31 and the silicon resin layer being the water repellent layer 32. The thickness t1 of the remaining natural oxide layer 36 is smaller than the thickness t2 of the oxide layer 35 situated on the wall surface 34*a* of the nozzle hole 34 (a natural oxide layer or oxide layer as a wet-proofing film separately formed for the wet-proofing of the nozzle base 31).

In other word, as discussed above, even if the water repellent layer is formed by applying the silicon resin on the nozzle base 31 after the acid treatment, plasma process, or ultraviolet ray process is applied to the nozzle base 31 so that the surface oxide layer is removed or a hydroxyl group substitution is made, the natural oxide layer 36 may be generated on the surface of the nozzle base 31 with time. However, by applying the silicon resin to form the water repellent layer before the natural oxide layer 36 completely covers the surface of the nozzle base 31, it is possible to obtain high adhesion strength between the jet surface side surface of the nozzle base 31 and the water repellent layer 32 being the silicon resin layer.

In this case, the silicon resin layer is not formed on the internal wall surface of the nozzle hole 34 of the nozzle base 31. Even if the oxide layer 35 is a natural oxide layer, the oxide layer 35 may further grow so that the oxide layer 35 is thicker than the natural oxide layer 36 remaining between the nozzle base 31 and the water repellent silicon resin layer 32. The natural oxide layer 35 per unit area of the nozzle internal wall surface 34*a* of the nozzle base 31 is greater than the natural oxide layer 36 per unit area of the surface of the nozzle base 31 where the silicon resin layer is formed.

Thus, since the thickness of the remaining natural oxide layer 36 between the nozzle base 31 and the silicon resin layer being the water repellent layer 32 is smaller than the thickness of the oxide layer 35 situated on the wall surface 34*a* of the nozzle hole 34 (a natural oxide layer or oxide layer as a wet-proofing film separately formed for wet-proofing the nozzle base 31), it is possible to obtain high adhesion strength between the jet surface side surface of the nozzle base 31 and the water repellent silicon resin layer 32. Hence, even if the silicon resin is applied in the air so that the water repellent layer 32 is formed, it is possible to obtain sufficient adhesion strength between the jet surface side surface of the nozzle base 31 and the water repellent silicon resin layer 32 and stable water repellency can be maintained. In other word, since the silicon resin is applied in the air so that the water repellent layer is formed, the water repellent layer can be easily formed so that the manufacturing cost of the liquid jet head can be reduced.

Figure 10:
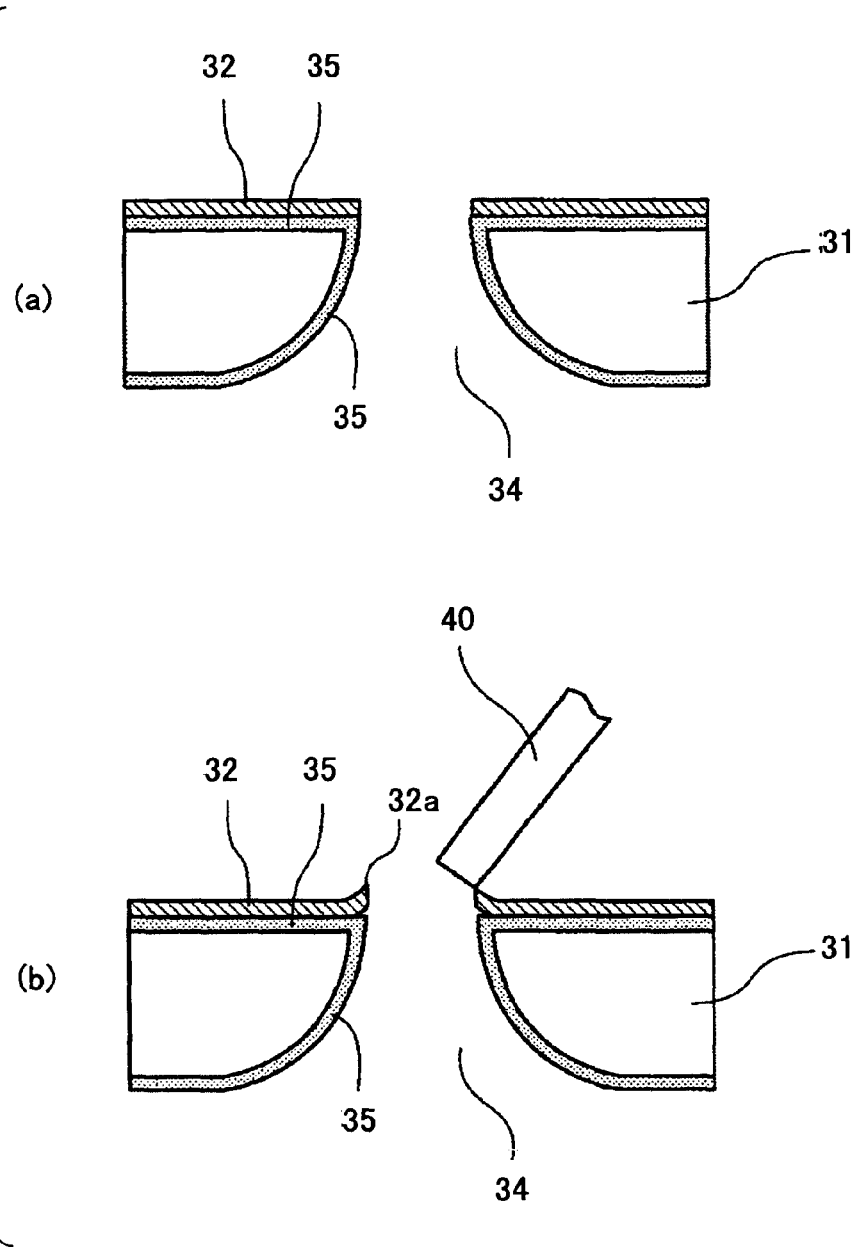
FIG. 10 is an enlarged cross-sectional view of a nozzle plate of a comparison example.

FIG. 10 is an enlarged cross-sectional view of a nozzle plate of a comparison example. In a case where the silicon resin is applied so that the water repellent layer 32 is formed after the oxide layer 35 is formed on even the jet surface side surface of the nozzle base 31 as shown in FIG. 10-(*a*), when the jet surface is wiped by the wiper blade 40 as shown in FIG. 10-(*b*), a circumference part 32*a* of the water repellent layer 32 facing the nozzle hole 34 may be easily peeled off and therefore stable water repellency cannot be maintained.

FIG. 11 is a table showing an example of experimental results of a relationship between existence of the oxide layer and peeling of the water repellant layer. The inventors of the present invention made an experiment of adherence of the water repellent layer 32 against ink soaking of the liquid jet head of the present invention and the liquid jet head discussed with reference to FIG. 10. As shown in FIG. 11, in a case where the oxide layer 35 is situated even on the jet surface side surface of the nozzle base 31, while peeling of the water repellent layer is not found at an initial stage, the peeling occurs after ink soaking. On the other hand, in a case where the oxide layer 35 is not provided on the jet surface side surface of the nozzle base 31 like the liquid jet head of the present invention (that is, a case where the oxide layer is not provided and a case where the natural oxide layer 36 is provided), peeling of the water repellent layer 32 does not occur at the initial stage nor after ink soaking. Thus, it is found that, in the liquid jet head of the embodiment of the present invention, the adhering strength between the water repellent layer 32 and the nozzle base 31 is improved.

Next, the relationship with ink to be used is discussed. FIG. 12 is a table showing an example of an experimental result of relationships between existence of the wet-proofing film (oxide layer) and elution of a nozzle base against characteristic of ink.

The inventors of the present invention made an experiment about the relationship between the ink and the case where the nozzle base 31 is made of Ni. As shown in FIG. 12, when ink PH equals 3 (acid side), if the oxide layer 35 as the wet-proofing film is formed on the nozzle internal wall surface 34*a*, a little elution of Ni is found. When ink PH equals 3 (acid side), if the oxide layer 35 as the wet-proofing film is not formed on the nozzle internal wall surface 34*a*, a lot of elution of Ni is found.

On the other hand, when ink PH equals 9 (alkaline side), if the oxide layer 35 as the wet-proofing film is formed on the nozzle internal wall surface 34*a*, no elution of Ni is found. When ink PH equals 9 (alkaline side), if the oxide layer 35 as the wet proof film is not formed on the nozzle internal wall surface 34*a*, a little elution of Ni is found. In addition, when the elution prevention agent of Ni is added in the ink, no elution of Ni is found even in a case where the oxide layer 35 is formed.

Thus, in the liquid jet head of the embodiment of the present invention, by using a liquid having an alkaline characteristic in a range between pH=8 through pH=11 as a recording liquid (ink), it is possible to reduce the elution of the nozzle base 31. The elution prevention agent is preferably added to the recording liquid so that the elution of the nozzle base 31 can be securely prevented.

In other words, in the liquid jet head of the embodiment of the present invention, as discussed above, since no oxide layer or a relatively thin natural oxide layer is provided between the nozzle base 31 and the water repellent layer of the silicon resin layer, it is preferable not to form the oxide layer as the wet-proofing film on the nozzle internal wall surface so that the oxide layer can be easily removed. However, by not forming the oxide layer as the wet-proofing film on the nozzle internal wall surface, in the case where the nozzle base 31 is made of Ni, Ni may be easily eluted depending on ink composition. Hence, it is preferable to reduce the elution of the nozzle base 31 by using an alkaline recording liquid having the alkaline characteristic in the range pH=8 through pH=11 or a recording liquid where an elution prevention agent is added.

In addition, the liquid jet head of the embodiment of the present invention can obtain good water repellency against a recording liquid including a fluoride chemical compound. That is, in a case where the recording liquid including a fluoride chemical compound such as a surface active agent is used, even if the water repellent layer of the fluoride resin is formed, it is found that sufficient water repellency cannot be obtained. On the other hand, by using the water repellent layer of the silicon resin, it is possible to obtain the water repellency sufficient against the recording liquid including the fluoride chemical compound.

In this case, by adding the fluoride chemical compound to the recording liquid, it is possible to make the dynamic surface tension be equal to or less than 30 mN/m. By using the recording liquid having the dynamic surface tension equal to or less than 30 mN/m, penetration rate of the ink into the paper is high. Especially, it is possible to shorten the drying time in a case where pigment ink is used.

Next, an example of a manufacturing method of the liquid jet head of the embodiment of the present invention is discussed with reference to FIG. 13. Here, FIG. 13 is a cross-sectional view for explaining the example of the manufacturing method of the liquid jet head of the embodiment of the present invention.

Figure 13:
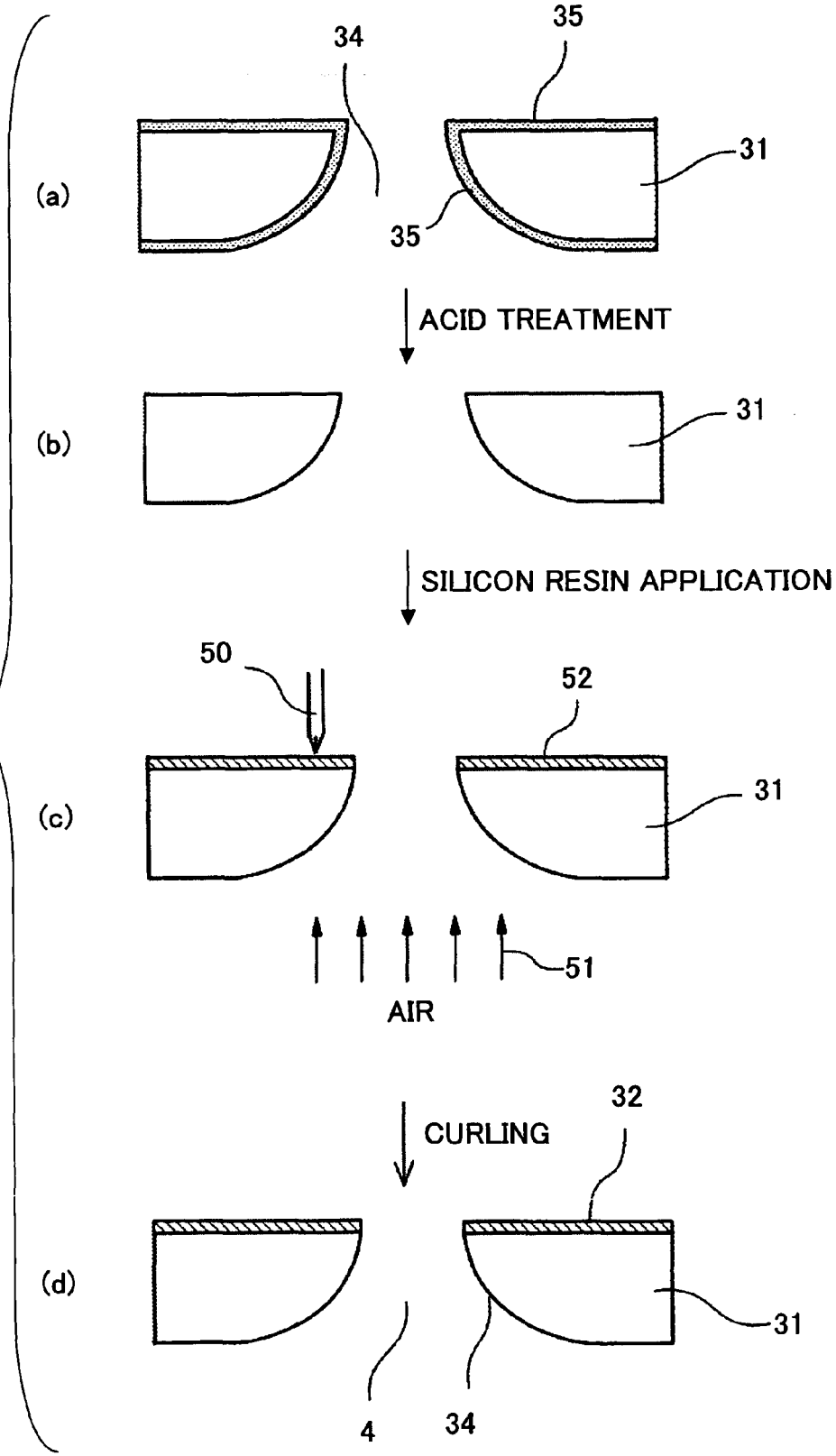
FIG. 13 is a cross-sectional view for explaining an example of a manufacturing method of the liquid head of the embodiment of the present invention.

First, as shown in FIG. 13-(*a*), an oxide layer 35 as a natural oxide layer or a wet-proofing film is formed on a surface of a nozzle base 31 formed by Ni electroforming. Then, as shown in FIG. 13-(*b*), acid treatment is applied so that the oxide layer situated on the surface of the nozzle base 31 is removed and hydroxyl group substitution is made on the surface. After that, as shown in FIG. 13-(*c*), in a state where air 51 is jetted from a surface side opposite to a jet surface side to the jet surface side via a nozzle hole 34 of the nozzle base 31, liquid state silicon resin is applied to the nozzle base 31 by a dispenser 50 so that the silicon resin film 52 is formed. After the silicon resin film 52 is cured, as shown in FIG. 13-(*d*), the water repellent layer 32 is formed.

Thus, by implementing the acid treatment and then removing the oxide layer, it is possible to form the water repellent layer 32 by applying the silicon resin in the air in a state where the oxide layer is not provided on the surface at the jet surface side of the nozzle base 31. In this case, in a time period from the acid treatment to application of the silicon resin, the nozzle base 31 is exposed to the air so that the natural oxide layer 36 may be formed on the surface of the nozzle base 31. However, as long as the natural oxide layer is thin, as discussed above, it is possible to obtain adherence strength between the silicon resin and the nozzle base 31.

Although the process for removing the oxidization film may be implemented by the plasma process or the ultraviolet irradiation process, the acid treatment is most simple and can be implemented at low cost.

Figure 14:
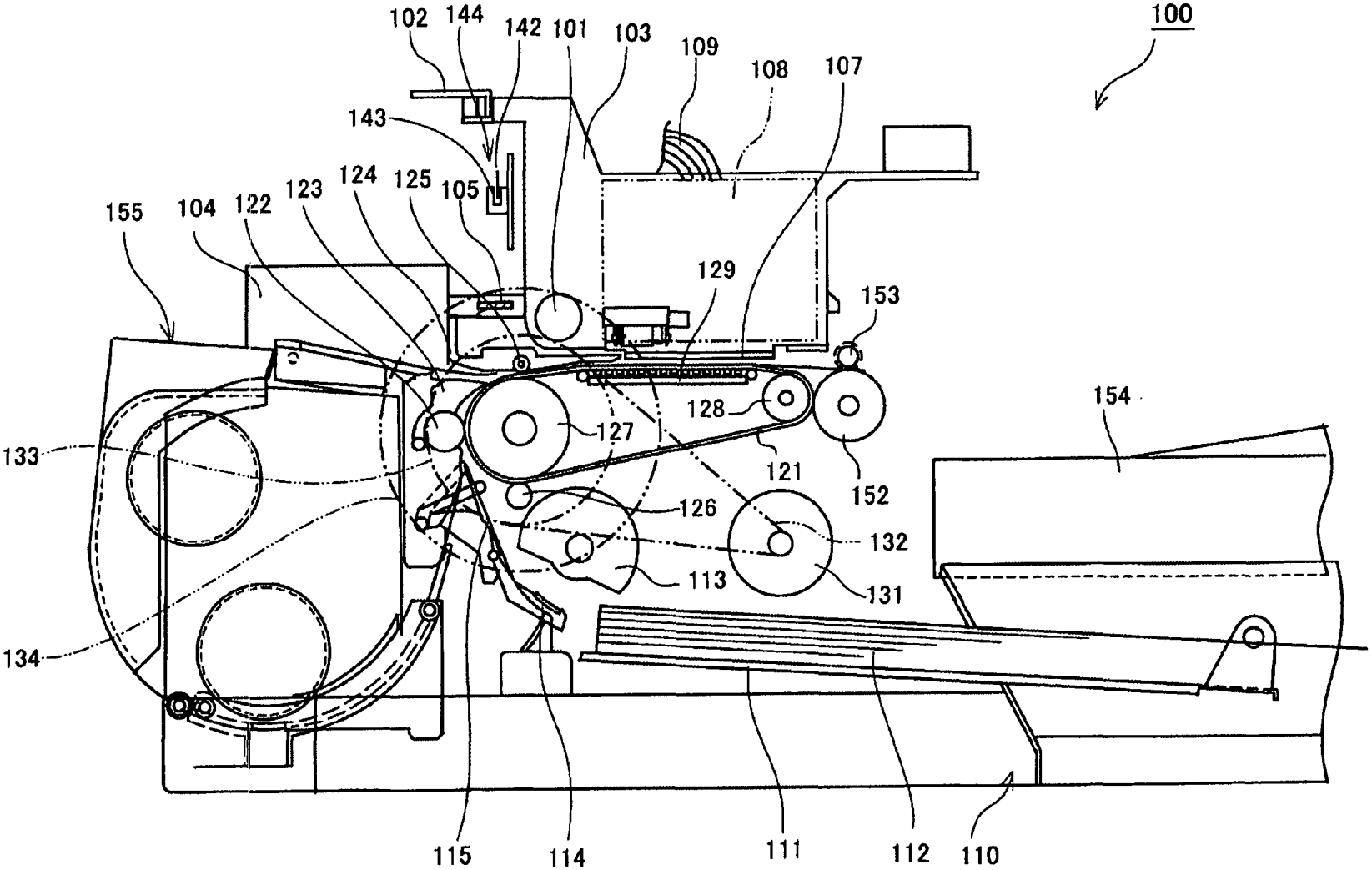
FIG. 14 is a side cut-away view of an image forming device of the embodiment of the present invention.
Figure 15:
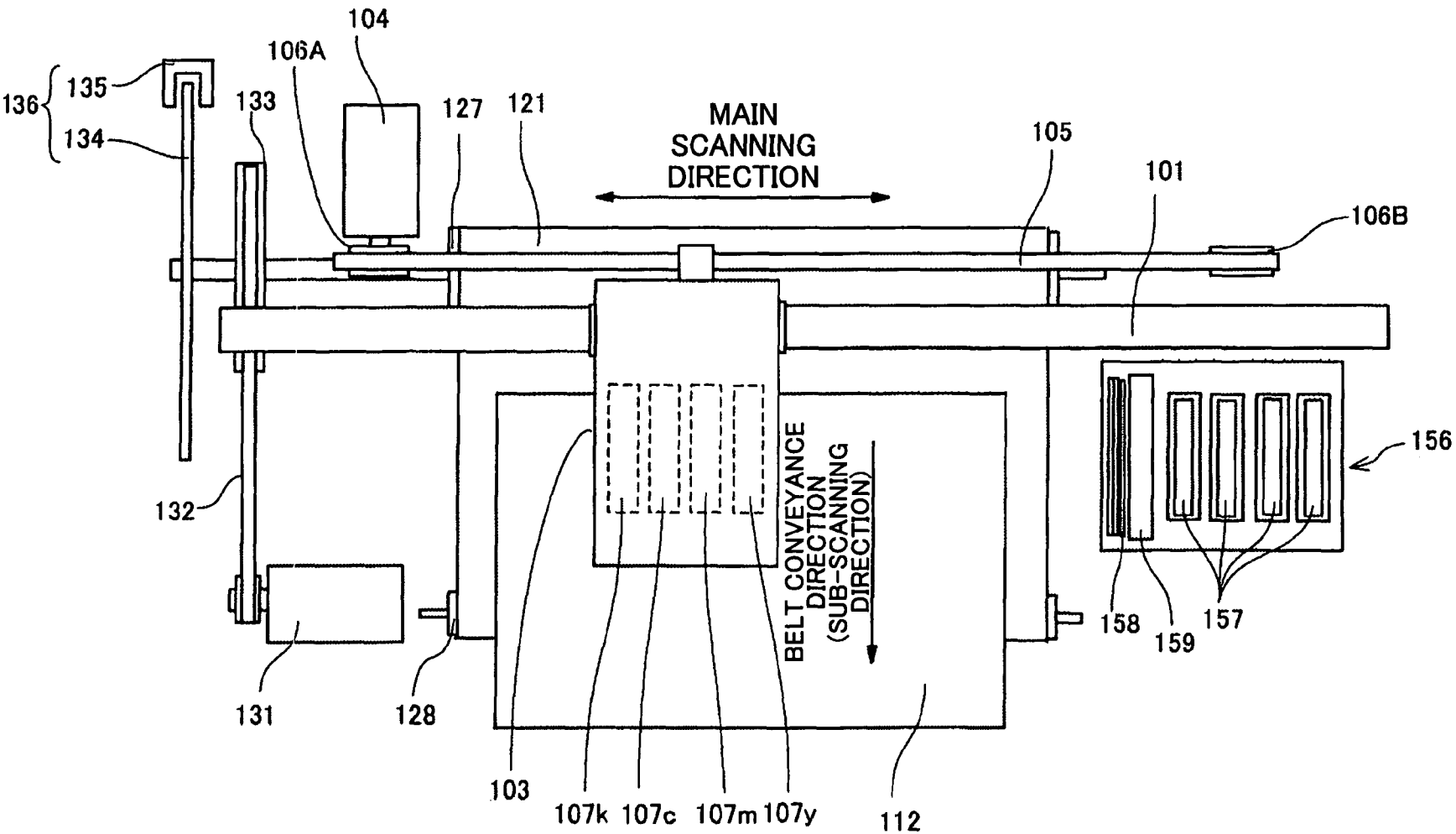
FIG. 15 is a plan view of a main part of the image forming device shown in FIG. 14.

Next, an example of an image forming device having the liquid jet head of the embodiment of the present invention is discussed with reference to FIG. 14 and FIG. 15. Here, FIG. 14 is a side cut-away view of the image forming device of the embodiment of the present invention, and FIG. 15 is a plan view of a main part of the image forming device shown in FIG. 14.

In this image forming device, a carriage 103 is held by a guide rail 101 and a guide rail 102 which are guide members provided between side plates left and right (not shown) so as to be able to slide in a main scanning direction. The carriage moves and scans in the main scanning direction indicated by an arrow in FIG. 14 via a timing belt 105 provided between a driving pulley 106A and an idler pulley 106B driven by a main scanning motor 104.

The carriage 103 includes a recording head 107 composed of four individual liquid jet heads 107*k*, 107*c*, 107*m*, and 107*y* of black (K), cyan (C), magenta (M), and yellow (Y), respectively, for ejecting ink droplets of respective colors. The recording head 107 is provided in a direction along a main scanning direction and ink is ejected from the ink ejection openings in the downward direction.

The recording head 107 may be formed by a single or plural liquid drop jetting heads having plural nozzle lines jetting different colors of ink.

The liquid jet head forming the recording head 107 may have a piezoelectric actuator such as a piezoelectric element, a thermal actuator which uses phase changes due to film boiling of liquid by using an electric thermal conversion element such as an exothermic resistor, a shape memory alloy actuator which uses metal phase changes based on temperature changes, or an electrostatic actuator which uses an electrostatic force, as an energy generation part configured to jet the ink (recording liquid).

The carriage 103 includes sub tanks 108 of the four colors for supplying the respective color inks to the recording head 107. The color inks are supplied from respective main tanks (ink cartridges) through ink supply tubes 109 to the corresponding sub tanks 108.

In addition, the image forming device includes a paper feeding part configured to feed papers 112 stacked on a paper stacking part (a pressure plate) 111 of a paper feeding tray 110. The paper feeding part includes a crescent-shaped roller (a paper feeding roller) 113 that separates and feeds the papers 112 one by one from the paper stacking part 111 and a separation pad 114 formed of a material with a high coefficient of friction and provided to oppose the paper feeding roller 113. The separation pad 114 is biased toward the paper feeding roller 113.

The image forming device also includes a conveying part configured to convey each of the recording media (papers) 112 fed from the paper feeding part below of the recording head 107. The conveying part includes a conveyance belt 121, a counter roller 122, a conveying guide 123, an edge pressure roller 125, and an electrostatic charging roller 126. The conveyance belt 121 conveys the paper 112 by causing the paper 112 to adhere electrostatically to the conveyance belt 121.

The paper 112 is fed through a guide 115 from the paper feeding part to be conveyed and held between the conveyance belt 121 and the counter roller 122. The conveying guide 123 changes the conveying direction of the sheet of paper 112 fed substantially vertically in the upward direction by substantially 90 degrees so that the paper 112 is conveyed on and along the conveyance belt 121. The edge pressure roller 125 is biased toward the conveyance belt 121 by a holding member 124. The electrostatic charging roller 126 forms a charging part that charges the surface of the conveyance belt 121.

The conveyance belt 121 is an endless belt and may be formed by connecting both ends of a belt having ends. The conveyance belt 121 is tensioned between the conveying roller 127 and the tension roller 128. The sub-scanning motor 131 rotates the conveying roller 127 via the timing belt 132 and the timing roller 133 so that the conveyance belt 121 is rotated in a belt conveyance direction of FIG. 14, namely a sub-scanning direction. A guide member 129 is provided at a rear surface side of the conveyance belt 121 corresponding to an image forming area of the recording head 107.

In addition, a slit disk 134 is provided at a shaft of the conveyance roller 127. A sensor 135 configured to detect the slits of the slit disk 134 and the slit disk 134 form an encoder 136.

The electrostatic charging roller 126 comes in contact with a surface layer of the conveyance belt 121 and is rotated following the rotation of the conveyance belt 121. Forces having 2.5 N are applied to both ends of the shaft as pressure forces.

An encoder scale 142 having a slit is provided at a front side of the carriage 103. An encoder sensor 143 being a transmission type photo sensor configured to detect the slit of the encoder scale 142 is provided at the front surface side of the carriage 103. The encoder scale 142 and the encoder sensor 143 form an encoder configured to detect a main scanning direction position of the carriage 103.

As a paper discharge part configured to discharge the paper 112 recorded on by the recording head 107, there are a separation part, paper discharge rollers 152 and 153 and a paper discharge tray 154. The separation part separates the paper 112 from the conveyance belt 121. The discharged papers 112 are stacked in the paper discharge tray 154.

A both sides paper feeding unit 155 is detachably provided at a rear side. The both sides paper feeding unit 155 takes in the paper 112 returned by a reverse rotation of the conveyance belt 121 and reverses the paper 112 so as to feed the paper 112 again between the counter roller 122 and the conveyance belt 121.

As shown in FIG. 15, a maintaining and recovering mechanism 156 for maintaining and recovering a state of the nozzle of the recording head 107 is provided in a non-printing area at one side in the scanning direction of the carriage 103.

The maintaining and recovering mechanism 156 includes caps 157, a wiper blade 158, a test jet receiving part 159, and others. Each of the caps 157 caps each of the nozzle surfaces of the recording head 107. The wiper blade 158 is a blade member for wiping the nozzle surface. The test jet receiving part 159 receives a liquid drop at the time of test jetting for jetting a thickening liquid not contributing to recording.

In the image forming device having the above-discussed structure, the papers 112 are separated and fed from the paper discharge part one by one. The paper 112 fed to the upper part in a substantially vertical direction is guided by the guide 115 and clamped and conveyed by the conveyance belt 121 and the counter roller 122. In addition, the head end of the paper 112 is guided by the conveyance guide 123. The paper 112 is pressed to the conveyance belt 121 by the head end pressing roller 125 and the conveyance direction of the paper 112 is changed by substantially 90 degrees.

At this time, a positive output and a negative output are alternately and repeatedly applied to the charging roller 126. In other words, an alternating voltage is applied so that positive and negative electrical charges are applied to the conveyance belt 121 in a rotation direction, namely a sub scanning direction, forming belts at a designated width. When the paper 112 is fed on the conveyance belt 121 that has alternately charged positive and negative belts, the paper 112 is adhered to the conveyance belt 121 by the electrostatic force. The paper 112 is conveyed in the sub-scanning direction by rotational moving of the conveyance belt 121.

Ink drops of a single line are jetted onto the stopped paper 112 for recording by driving the recording head 107 corresponding to the image signal while the carriage 103 is moved in the main scanning direction. After the paper 112 is conveyed at a designated length, recording for the next line is performed. A recording finishing signal or a signal indicating that the rear end of the paper 112 has reached a recording area is received, so that the recording operation is finished and the paper 112 is discharged to the paper discharge tray 154.

In a case of the both sides printing, when recording on a first surface is completed, the conveyance belt 121 is reverse-rotated so that the paper where recording is completed is sent in the both sides paper feeding unit 155. The paper 112 is reversed so that a second surface is now the printing surface and the paper 112 is fed again between the counter roller 122 and the conveyance belt 121. The timing control is performed and the paper 112 is conveyed on the conveyance belt 121 for printing the rear surface (second surface) and then the paper 112 is discharged to the paper discharge tray 154.

During waiting for printing (recording), the carriage 103 is moved to the maintaining and recovering mechanism 155 side and the nozzle surface of the recording head is capped by the cap 157. As a result of this, the nozzle is maintained in a moist state so that bad jetting due to ink drying can be prevented. In addition, in a state where the recording head is capped by the cap 157, nozzle suction or head suction is implemented so that the recording liquid is suctioned from the nozzle so that recovering operations for discharging thickened recording liquid and the bubbles is implemented. Furthermore, in order to remove the ink adhered on the nozzle surface of the recording head 107 by this recovering operation, wiping is implemented by the wiper blade 158. In addition, test jet operation is implemented so that the ink not related to recording is jetted before starting recording or during recording. Because of this, it is possible to maintain the stable jetting property of the recording head 107.

Thus, since the image forming device has the liquid jet head of the embodiment of the present invention, the water repellent layer 32 is not peeled even if wiping is implemented by the wiper blade 158 of the maintaining and recovering mechanism 155. It is possible to maintain stable and sufficient water repellency for a long time and obtain stable liquid jetting characteristic. Hence, it is possible to stably form a high quality image.

In the meantime, while a printer structure is discussed in the above-discussed embodiment as the image forming device of the present invention, the present invention is not limited this. For example, the present invention can be applied to the printer, facsimile, copier or the multiple function processing machine of the printer, facsimile, and copier. In addition, the present invention can be applied to a case where liquid other than ink is used as the recording liquid.

Second Embodiment of the Present Invention

Figure 16:
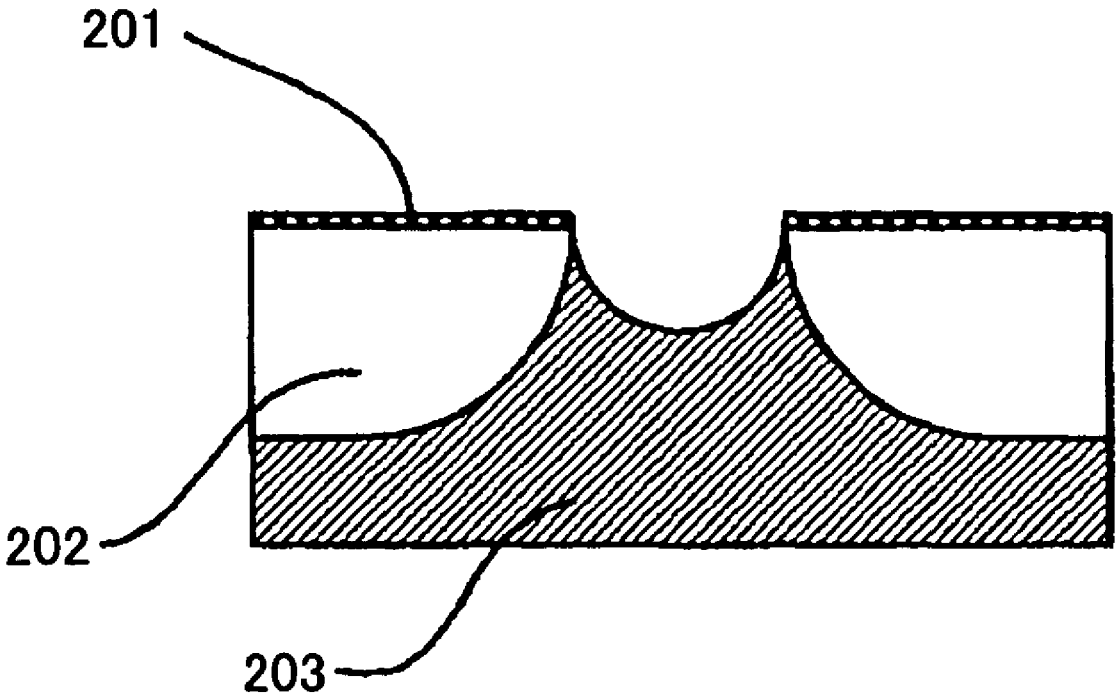
FIG. 16 is a cross-sectional view of the liquid jet head nozzle plate of the embodiment of the present invention.
Figure 17:
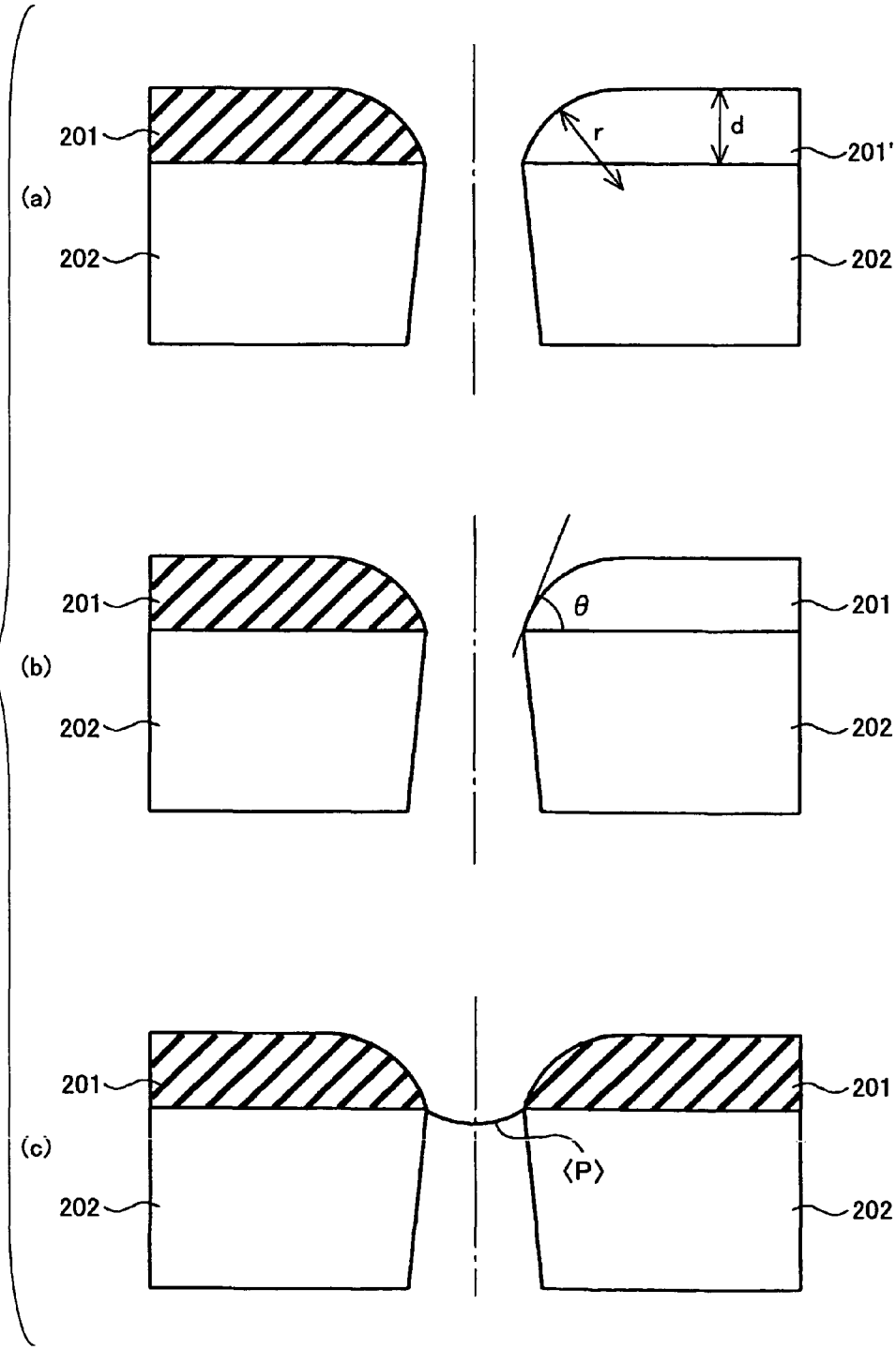
FIG. 17 is a view for explaining a configuration characteristic of a part shown in FIG. 16.

FIG. 16 is a cross-sectional view of the liquid jet head nozzle plate of the second embodiment of the present invention. FIG. 17 is a view for explaining a configuration characteristic of a part shown in FIG. 16.

In the second embodiment of the present invention, a nozzle plate 202 being a base of the liquid jet head is manufactured by Ni electroforming, An ink repellent film 202 which is a silicon rein film having the thickness of 0.1 μm or more is formed on the surface of the nozzle plate 202. It is preferable that the surface roughness Ra of the ink repellent layer 201 be equal to or less than 0.2. It is more preferable that this film thickness of the ink repellent film be equal to or greater than 0.5 μm.

As shown in FIG. 17-(*c*), at the time when the ink 203 fills the liquid room 6, a meniscus (liquid surface) P is formed at the boundary part between the nozzle plate 202 and the ink repellent film 201 made of the silicon resin film.

The opening part of the nozzle plate 202 is formed so that the cross section perpendicular to the center line indicated by one-dotted lines in FIG. 17 has a substantially circular-shaped configuration wherein the center line is the center. The ink repellent film 201 formed on the ink jet surface of the nozzle plate 202 has a cross section perpendicular to the center line and the cross section is bigger as the cross section is further separated.

More specifically, as shown in FIG. 17-(*a*), the opening part of the ink repellent film 201 has a round configuration wherein a curved part from the opening edge end to the vicinity of the opening part of the nozzle plate 202 has a curvature radius r. It is preferable that the curvature radius r be equal to or greater than the thickness d at a part of the ink repellent film 201 other than the vicinity of the opening part. This thickness d may preferably be a maximum thickness of the ink repellent film.

Thus, the opening part of the ink repellent film 201 connecting to the opening part of the nozzle plate 202 has a curved configuration not having a substantially sharp edge and not having a hanging part. Hence, even if wiping is performed by a wiper made of rubber, the sharp part may not hang up the wiper and the ink repellent film 201 may not be peeled from the nozzle plate 202.

In addition, as shown in FIG. 17-(*b*), it is preferable that the angle θ, formed by a tangent line passing the edge end of the opening part of the ink repellent film 201 on the cross section where the center line of the opening part of the nozzle plate 202 passes and a nozzle plate 202 surface including the opening edge end of the nozzle plate 202 connecting the opening edge end of the ink repellent film 202, be less than 90 degrees.

Thus, since the angle θ formed by the tangent line at the end edge of the opening part of the water repellent film 201 and the nozzle plate surface 202 is less than 90 degrees, as shown in FIG. 17-(*c*), the meniscus (liquid surface) P is stably formed at the boundary part of the ink repellent film 201 and the nozzle plate 202 and the likelihood that the meniscus P will be formed at another part can be reduced.

Thus, since the forming surface of the meniscus can be stable, it is possible to stabilize jetting of the ink, when forming an image with the image forming device including the liquid jet head including the nozzle plate 202.

As silicon resin used in this embodiment of the present invention, normal temperature curing type liquid state silicon resin is preferable and resin accompanied by hydrolysis reaction is especially preferable. In the following example, SR 2411 made by Toray Dow Corning Corporation is used.

The "Table 1" mentioned below shows a relationship between configuration from the opening part edge end to the vicinity of the opening part edge end of the nozzle plate 202 and results of evaluation of ink adhering around the nozzle, edge peeling and jet stability, in the ink repellent film 201 of the liquid jet head of the embodiment of the present invention.

TABLE 1

| Edge configuration | | Ink adhering | Edge peeing | Jet stability |
|---|---|---|---|---|
| Sharp edge exists | | Partial generation | Generation | Good |
| No sharp edge (Round Configuration) | θ ≦ 90° | NO | NO | GOOD |
| | θ > 90° | NO | NO | BAD |
| | r ≧ d | NO | NO | GOOD |
| | r < d | NO | Partial Generation | BAD |

In the configuration where the substantially sharp edge is included in the edge part (the vicinity of the opening edge end) of the ink repellent film 201, ink adhering is found around the nozzle and peeling of the edge due to wiping is generated.

In the round configuration, ink does not adhere. In the comparison example shown in FIG. 18-(*a*) where r is smaller than d (r<d), peeling of the edge is partially generated.

Figure 18:
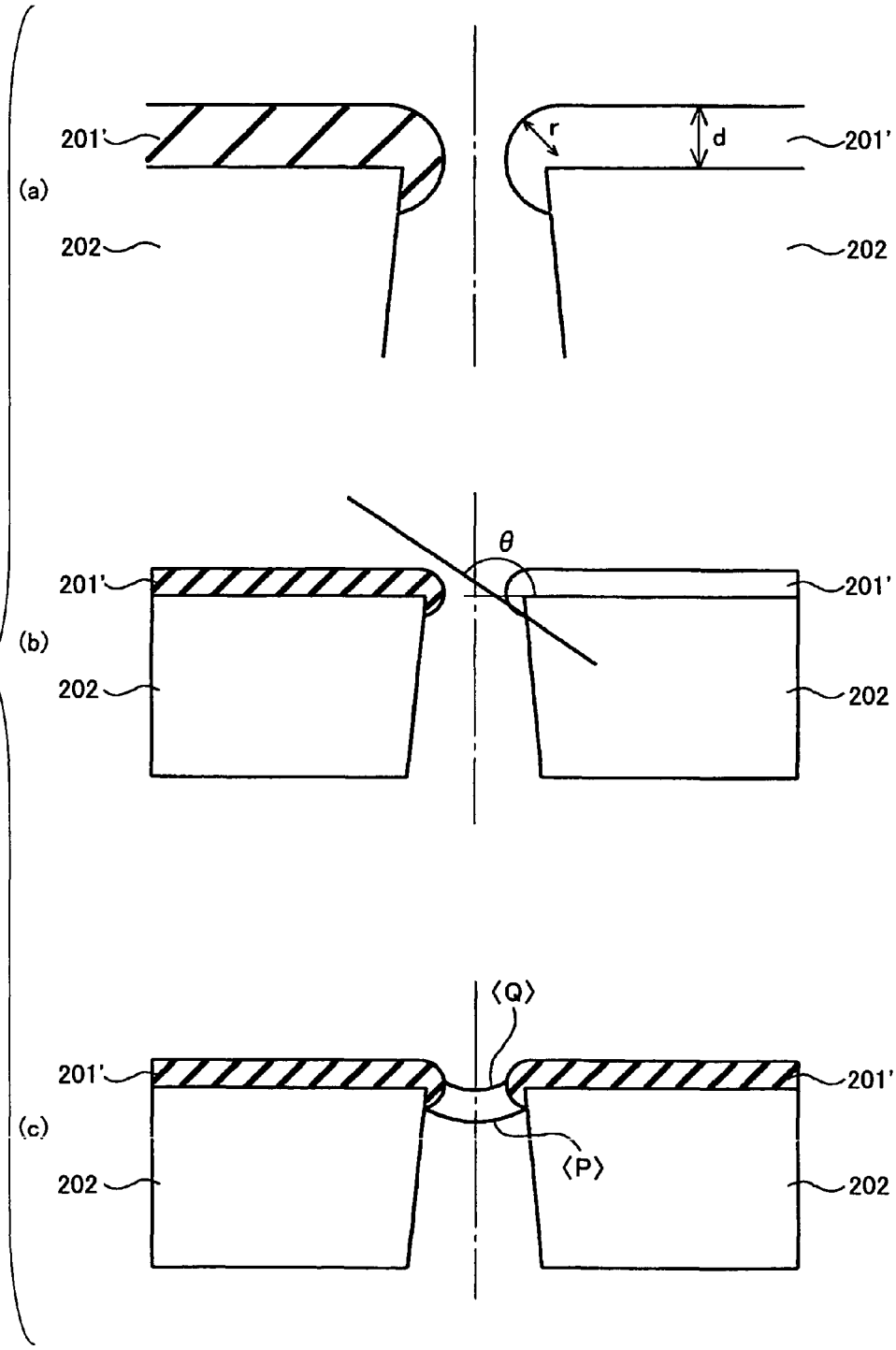
FIG. 18 is a view for explaining a configuration characteristic of a comparison example.

In the comparison example shown in FIG. 18-(*b*) where θ is greater than 90 degrees (θ>90 degrees), jetting of the liquid drop is unstable.

That is, as shown in FIG. 18(*c*), in a case of r<d or θ>90 degrees, at the time when the ink 203 fills the liquid room 6, the meniscus (liquid surface) P may be formed at the boundary part of the ink repellent film 201 and the nozzle plate 202 or the meniscus Q may be formed at the convex part toward the center of the opening part of the ink repellent film 201', namely a part where the cross-section perpendicular to the center line of the opening part is smallest. Because of this, unevenness of jetting stability of the ink when the image is formed by the image forming device using the liquid jet head using the nozzle plate 202 may be generated.

Next, an example of the manufacturing method of the nozzle member of the liquid jet head of this embodiment of the present invention is discussed.

Figure 19:
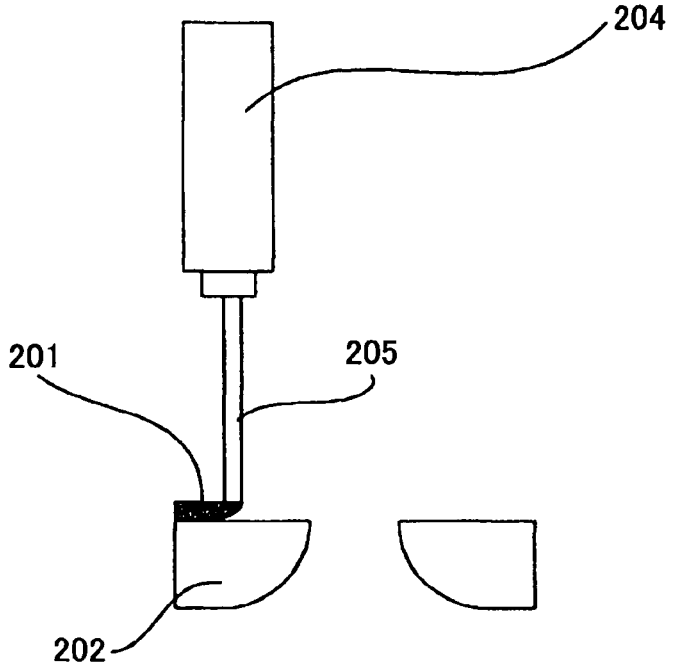
FIG. 19 is a view showing a structure where an ink repellent film is formed by application using a dispenser 204 of the embodiment of the present invention.

FIG. 19 is a view showing a structure where the ink repellent film 201 is formed by application using a dispenser 204 of this embodiment of the present invention.

The dispenser 204 is used for applying silicon solution at the ink jet surface side of the nozzle by Ni electroforming. While silicon is jetted from the head end of the needle 205, the dispenser 204 is scanned so that the distance between the nozzle plate 202 and the head end of the needle 205 keeps a predetermined distance. As a result of this, silicon resin film is selectively formed on the ink jet surface of the nozzle plate 202 as shown in FIG. 16 and FIG. 17.

As silicon resin used in this embodiment of the present invention, normal temperature curing type silicon resin SR 2411 made by Toray Dow Corning Corporation and having coefficient of viscosity of 10 mPa·s is used. However, it is found that silicon is slightly provided around the nozzle hole or the rear surface of the nozzle plate. The silicon resin film selectively formed has a thickness of 1.2 μm and surface roughness Ra of 0.18 μm.

Figure 20:
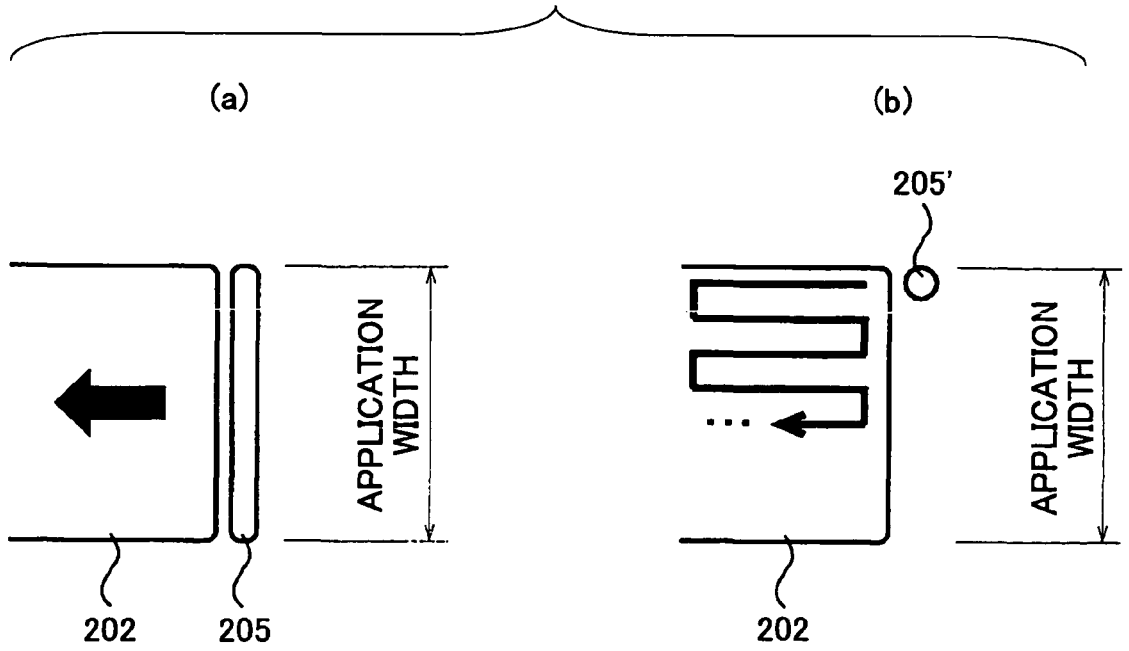
FIG. 20 is a view showing a relationship between a configuration of a head end of (a) a needle in the embodiment of the present invention and (b) a related art case.

FIG. 20 is a view showing a relationship between a configuration of the head ends of (a) the needle in the embodiment of the present invention and (b) the related art.

As shown in FIG. 20-(*a*), the width of an application opening of the head of the needle 205 of this embodiment of the present invention is sufficient for applying a film onto the nozzle plate 202 being a subject of the application. Because of this, by scanning the dispenser 204 in the application direction only one time, it is possible to complete the application onto the entirety of the subject of the application.

In other words, the scanning direction for the applying operation can be only a single direction. Therefore, it is not necessary to change the direction or scan in the opposite direction as shown in FIG. 20-(*b*).

Here, as shown in FIG. 20-(*b*), the head end of the general purpose needle 205 is extremely narrower than the application width of the nozzle plate 202 being a subject of the application. Therefore, in order complete the application to the entirety of the subject of the application, it is necessary to change the scanning direction for the applying operation at 90 degrees or scan in the opposite direction for scanning in plural directions. Hence, it is difficult to apply a film onto the entirety of the subject of the application with even thickness.

According to this embodiment of the present invention, since the width of the application opening of the head of the needle 205 of this embodiment of the present invention is sufficient for applying to the nozzle plate 202 being a subject of the application, it is possible to make the entire thickness of the application even so that the surface may be formed at a high precision.

Figure 21:
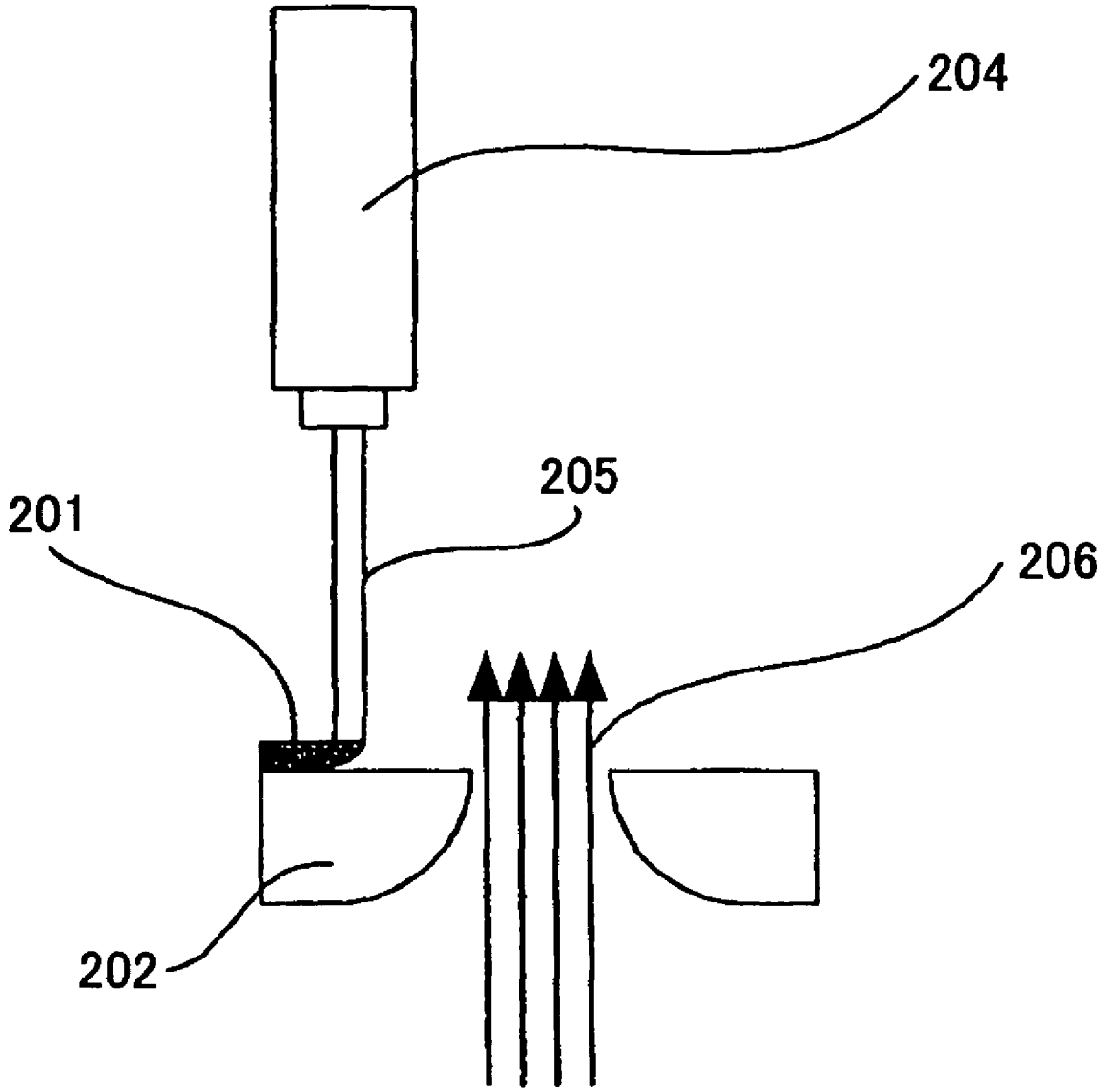
FIG. 21 is a view showing an operation for forming the ink repellent film by using the dispenser of the embodiment of the present invention.

FIG. 21 is a view showing an operation for forming the ink repellent film by using the dispenser 204 of the embodiment of the present invention. Although the basic structure is the same as that shown in FIG. 19, gas 206 is jetted from the nozzle hole (opening part) of the nozzle plate 202, while silicon is applied. Various gases as the gas 206 may be applied as long as the gas does not chemically react with the applied silicon. For example, air can be used.

Thus, since application is made while the gas 206 is jetted from the nozzle hole, the silicon resin film can be formed on the nozzle surface of the nozzle plate 202 excluding the nozzle hole.

Figure 22:
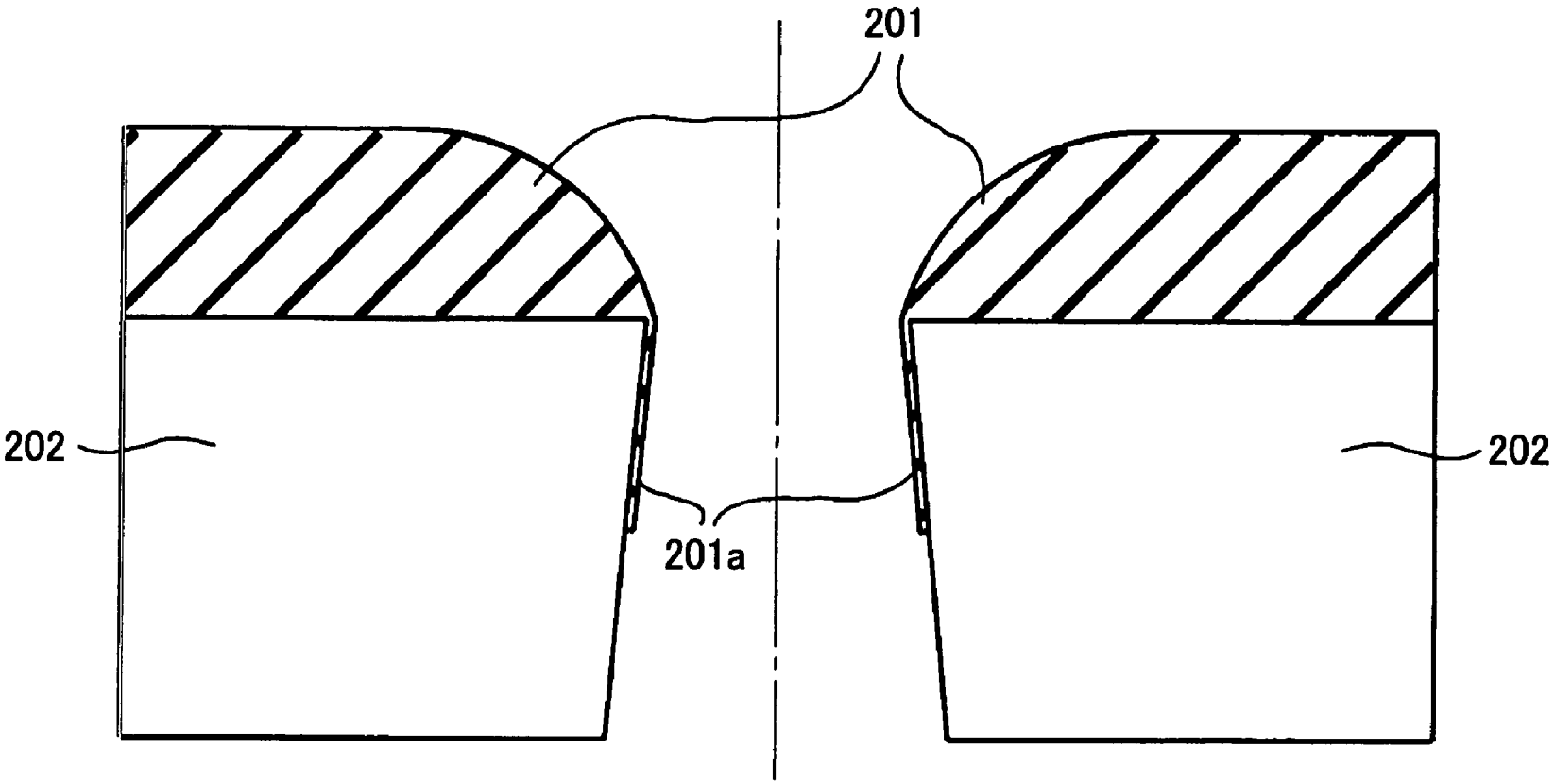
FIG. 22 is a cross-sectional view of a liquid jet head nozzle plate in a case where an ink repellent film of an internal wall of an opening part and an ink repellent film of an ink jet surface are formed.

In addition, after the silicon resin is applied without jetting the gas 206 so that the silicon resin enters to the designated depth, the gas 206 is jetted from the nozzle 202 so that, as shown in FIG. 22, the ink repellent layer where the silicon resin is at a desirable depth of the nozzle internal wall (for example, several μm) can be formed.

In other words, in addition to the ink repellent film 202 of the ink jet surface, an extremely thin ink repellent film 201*a* (the ink repellent film of the opening part internal wall) can be formed at predetermined depth from the opening part edge end of the nozzle plate 202.

The ink repellent film 201 is wiped by using EPDM rubber (ethylene-propylene-diene-methylene rubber) having rubber strength of 50 degrees. As a result of this, the ink repellent film 201 of the nozzle plate can keep good ink repellency for 1000 times wiping. In addition, the nozzle member where the ink repellent film is formed is soaked in the ink having temperature of 70° C. for fourteen days. As a result of this, ink repellency not changed from that of the initial stage can be maintained after this.

Comparison of the ink repellency against the ink between the nozzle plate S1 of this embodiment where the ink repellent film 201 made of silicon resin is formed and the related art nozzle plate C1 where eutectoid plating of Ni/PTFE is applied, where a heating process of 350° C. is applied for 60 minutes, is shown at table 2. Conditions of ink for evaluating the ink repellency are surface tensions of 20 mN/m and 35 mN/m and whether a fluoride group surface active agent is contained. The fluoride group surface active agent used in this comparison is FS-300 made by Du Pont Kabushiki Kaisha. In the embodiment of the present invention., it is preferable that the surface tension of the fluoride group surface active agent be lower. For example, 70 mN/m is preferable, 50 mN/m is more preferable, 15 through 50 mN/m is further preferable, and 15 through 40 mN/m is not preferable. Under this structure, wetness penetration rate of ink into a recording medium such as a paper is improved so that high quality printing can be obtained.

TABLE 2

| | Surface tension of ink (mN/m) | | | |
|---|---|---|---|---|
| | 20 | | 35 | |
| Existence of fluoride group surface active agent | YES | NO | YES | NO |
| S1 (silicon resin) | ○ | ○ | ○ | ○ |
| C1 (fluoride resin) | X | X | X | ○ |

As shown in table 2, the related art nozzle C1 does not obtain the ink repellency against the ink having the surface tension of 20 mN/m and containing the fluoride group surface active agent. On the other hand, the nozzle plate S1 manufactured according to the embodiment of the present invention can obtain good ink repellency against the inks mentioned in the table 2.

As a water repellent material forming the ink repellent film 201 of the embodiment of the present invention, an organic compound having a fluoride atom, especially, an organic compound having a fluoroalkyl group, an organic silicon compound having a dimethylsilixan backbone or the like is used.

Fluoroalkylsilane, amine, alcohol, carboxylic acid, alcohol, or alkane having a fluoroalkyl group is preferable as the organic compound having the fluoride atom. More specifically, heptadecafluoro-1,1,2,2-tetrahydrodecyltrimethoxysilane or heptadecafluoro-1,1,2,2-tetrahydrotrichlorosilane is used as the fluoroalkylsilane; octafluorocyclobutane, perfluorohexahydrotoluene, perfluoro-n-hexane, perfluoro-n-heptane, tetradecafluoro-2-methylpentene, perfluorododecane, or perfluoroicosane is used as the alkane having the fluoroalkyl group; perfluorododecane acid or perfluorooctane acid is used as the carboxylic acid having the fluoroalkyl group; 3,3,4,4,5,5,5-heptafluoro-2-pentanol is used as the alcohol having the fluoroalkyl group; and heptadecafluoro-1,1,2,2-tetrahydrodecylamine is used as the amine having the fluoroalkyl group. α,w-bis(3-aminopropyl)polydimethylsiloxane, α,w-bis(3-glycidoxypropyl3)polydimethylsiloxane, or α,w-bis(vinyl)polydimethylsiloxane is used as the organic silicon compound having a dimethylsilixan. backbone.

In addition, as another water repellent material, an organic compound giving a silicon atom, especially, an organic compound having an alkylsiloxane group is used.

As the organic compound having the alkylsiloxane group, a molecule forming an alkylsiloxaneepoxy resin composition and containing the alkylsiloxane group is used. As the alkylsiloxaneepoxy resin composition having two or more ring aliphatic epoxy groups, for example, a high molecular compound (A) including a structural unit indicated by the following chemical formulas (a) and (b) is used.

[Chemical Formulas]

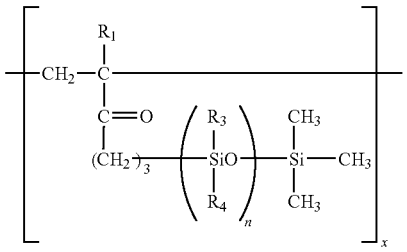

(a)

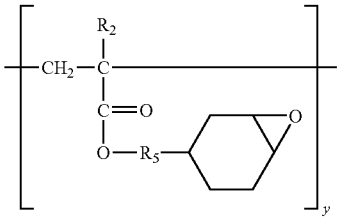

(b)

In the above-mentioned formulas, x is an integer in a range of 1-50; y is an integer in a range of 2-100; and n is an integer in a range of 2-100.

$R_1$ and $R_2$ : Indepently —H or —$CH_3$ $R_3$ and $R_4$ : Indepently —$CH_3$ or 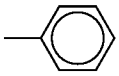

$R_5$ : —$CH_3$—, —$CH_2CH_2$—, —$CH_2CH(CH_3)$—

The high molecular compound (A) having structures indicated by the above-mentioned chemical formulas (a) and (b) works as a binder when the high molecular compound (A) is used with other water repellent chemical compounds. In other words, it is possible to improve application suitability of the ink repellent composition and improve operability as a dry application film for improving drying characteristics after the solvent is evaporated.

Thus, in this embodiment, since the ink repellent film 201 is formed by application using the dispenser 204, it is possible to use a material as the material of the ink repellent film 201 even if the material is cured in the air and at the normal temperature, that is, cannot be left in the air at the normal temperature for a long time.

In addition, as discussed above, the material of the ink repellent film 201 may be fluoride resin or silicon resin.

As discussed above, in the liquid jet head of the embodiment of the present invention, the ink repellent film 201 is formed at the ink jet surface side of the nozzle plate 202. A round configuration is formed at the opening part of the ink repellent film 201, namely from the opening part edge end of the nozzle plate 202 to the vicinity of the opening part edge end.

Because of this, the nozzle edge part, namely an opening part of the ink repellent film 201, is protected from external force due to for example, wiping. Hence, high durability of the liquid jet head can be realized.

In addition, in the liquid jet head of the embodiment of the present invention, the curvature radius r of the round part of the ink repellent film 201 formed on the surface of the nozzle plate 202 is equal to or less than the thickness of the ink repellent film 201 other than the opening part. Therefore, peeling in the vicinity of the opening part edge end of the ink repellent film 201 may not be generated and jetting stability of the liquid jet head can be improved.

In the liquid jet head of the embodiment of the present invention, since inclination θ of the tangent line of the round part passing through the nozzle edge part is equal to or less than 90 degrees, the ink drop being jetted does not come in contact with the ink repellent film and therefore jet stability is good.

In addition, since the thickness d of the ink repellent film 201 formed on the surface of the liquid jet head of the embodiment of the present invention is equal to or less than 10 μm, the nozzle can have extremely good adherence and durability.

Furthermore, the ink repellent film 201 formed on the nozzle plate of the liquid jet head of the embodiment of the present invention may be made of fluoride resin. Therefore, residual of the ink at the time of wiping may not be generated so that it is possible to obtain the stable jetting characteristic.

In addition, since the ink repellent film 201 formed on the nozzle plate of the liquid jet head of the embodiment of the present invention may be made of silicon resin, moving characteristic of the ink is good and the ink adhered around the nozzle can be easily moved to the nozzle hole. Therefore, it is possible to make the area surrounding the nozzle hole clean so that it is possible to obtain the stable jetting characteristic.

Furthermore, since the base of the nozzle plate of the liquid jet head of the embodiment of the present invention may be made of metal, it is possible to make a stable liquid jet head having extremely good rigidity.

In addition, since the base of the nozzle plate of the liquid jet head of the embodiment of the present invention may be made of resin, adherence with the ink repellent film 201 is extremely good and the liquid jet head has good durability.

Furthermore, in the manufacturing method of the liquid jet head of the embodiment of the present invention, it is possible to form the ink repellent film 201 in the air. Therefore, it is possible to easily form the ink repellent film 201 by low cost equipment.

In addition, in the manufacturing method of the liquid jet head of the embodiment of the present invention, the material of the ink repellent film can be applied by the dispenser. Therefore, it is possible to apply a necessary amount of resin at a necessary place. Hence, it is possible to freely adjust the film thickness d of the ink repellent film with precision and the ink repellent film 201 can be formed at extremely low cost.

Furthermore, in the manufacturing method of the liquid jet head of the embodiment of the present invention, since the resin is applied on the surface by the dispenser while the gas is jetted from the rear surface side to the surface side of the nozzle base via the nozzle hole, it is possible to embed the ink repellent film 201 in the nozzle hole so that the ink repellent film 201 can be formed at extremely low cost with high yield.

In addition, in the manufacturing method of the liquid jet head of the embodiment of the present invention, since gas is jetted from the rear surface side to the surface side of the nozzle base via the nozzle hole after the resin is applied on the nozzle base surface by the dispenser, it is possible to apply the resin film at the optimal depth on the nozzle hole internal wall. Therefore, it is possible to form the ink repellent film 201 at extremely low cost and with high yield.

Furthermore, according to the liquid jet head having the nozzle member of the embodiment of the present invention, the ink repellent film may not be peeled by the wiping during head cleaning. In addition, it is possible-to obtain high jet stability. Therefore, it is possible to provide the liquid jet head that produces high image quality and has high durability.

In addition, according to the cartridge having the liquid jet head of the present invention, the ink repellent film of the head part may not be peeled by the wiping during head cleaning. In addition, it is possible to obtain high jet stability. Therefore, it is possible to provide the liquid jet head that produces high image quality and has high durability.

The cartridge may have an ink supply part provided at the liquid jet head or an installing part for a liquid jet recording device main body so as to be exchangeable.

Furthermore, the liquid jet recording device of the embodiment of the present invention has the liquid jet head of the embodiment of the present invention. Therefore, it is possible to provide the liquid jet recording device having good durability and stable jetting capability at low cost.

In the liquid jet recording device of the embodiment of the present invention, it is possible to use the ink having low surface tension. Hence, it is possible to improve fixing ability of the ink on the recording medium such as the paper.

In addition, in the liquid jet recording device of the embodiment of the present invention, the ink to be used may contain the fluoride group surface active agent. Therefore, it is possible to form an image with high coloring.

Furthermore, the ink may contain the pigment. Therefore, it is possible to form a high quality image having high weathering ability and water resistance even on normal paper.

Here, in the related art, the fluoride resin is used as the nozzle plate ink repellent layer of the liquid jet head. For example, a thin film of PTFE (polytetrafluoroethylene) is formed on the nozzle plate surface by applying eutectoid plating of Ni/PTFE on the metal nozzle plate surface and a heating process. Alternatively, the fluoride group water repellent agent is coated on the nozzle plate surface made of metal or resin. In the nozzle plate where the fluoride resin is used as the ink repellent layer, in a case of the pigment ink or dye ink having the surface tension equal to or greater than 30 mN/m, it is possible to achieve high ink repellency. However, in a case of the ink having a low surface tension such as 15 through 30 mN/m or the ink where the fluoride group surface active agent is added, it is difficult to obtain sufficient ink repellency.

In addition, in the related art, the ink repellent layer having a good ink moving ability is formed by forming the silicon resin film on the nozzle plate surface of the liquid jet head. For example, a liquid state silicon resin material is vacuum-deposited. The silicon oil is plasma polymerized. In these methods, it is necessary to implement a vacuum process at the time of deposition so that large size equipment is required and cost increases.

Furthermore, in the case where the silicon resin film is formed by vacuum deposition or plasma polymerization, since deposition time is long and the film to be formed is extremely thin, a defect such as a pin hole may be generated.

In addition, in the case where the silicon resin film is formed by vacuum deposition or plasma polymerization, it is difficult to make the film thick so as to obtain the sufficient durability against the wiping or the ink.

Furthermore, in the related art, in a state where gas is jetted from the nozzle hole, the nozzle is soaked in the solution where the ink repellent agent is dissolved so that the ink repellent layer is formed on the nozzle plate surface. However, in this method, since the nozzle is soaked in the solution while the gas is jetted, air bubble may be generated. In a case where the solution is a normal temperature curing type, the solution has to be left in the air. Hence, it is difficult to maintain the liquid state and may be impossible to control film thickness of the ink repellent layer by change of viscosity of the solution.

On the other hand, the nozzle plate ink repellent layer of the liquid jet head of the embodiment of the present invention is made by evenly, smoothly, and efficiently forming the silicon resin film having the ink repellency and low surface tension on the nozzle plate surface. Therefore, it is possible to obtain sufficient ink repellency against the ink having low surface tension of 15 through 30 mN/m or the ink where the fluoride group surface active agent is added. Since such a film keeps the ink repellency good for continuity or durability, it is possible to provide a liquid jet head performing high quality printing for a long time.

In addition, in the nozzle plate ink repellency processing method of the liquid jet head of the embodiment of the present invention, the liquid state silicon is applied to a necessary part of the nozzle plate where the nozzle hole is formed in advance by the dispenser so that an even and smooth silicon resin film is formed on the nozzle plate surface. By making the silicon resin film have the thickness equal to or greater than 0.1 μm, more preferably equal to or greater than 0.5 μm, it is possible to improve durability against wiping or ink durability.

Furthermore, by making the surface roughness Ra of the silicon resin equal to or less than 0.2 μm, it is possible to reduce residual of ink at the time of wiping. It is preferable that the viscosity of the liquid state silicon be equal to or less that 1000 cp in order to form a smooth surface.

In the nozzle plate ink repellent processing method of the liquid jet head of the embodiment of the present invention, the silicon coating (application) is made by the dispenser while the gas is jetted from the nozzle hole and the silicon resin is cured, so that the ink repellent layer of the silicon resin can be formed on only the surface of the nozzle plate. After the silicon resin is coated on the nozzle plate surface, the gas is jetted from the nozzle hole so that the ink repellent layer can be formed at the desirable depth of the nozzle hole inside wall.

In addition, the silicon resin that is a material used for the nozzle plate ink repellent process of the liquid jet head of the embodiment of the present invention may be the normal temperature type liquid state silicon resin or an elastomer. Because of this, by leaving it in the air for several minutes or one hour after the coating, it is possible to form the silicon resin film having durability.

Furthermore, the silicon resin that is a material used for the nozzle plate ink repellent process of the liquid jet head of the embodiment of the present invention may be a heat curing type liquid state silicon resin or elastomer. Because of this, it is possible to form the silicon resin film having durability by applying a heating process at several tens ° C. through one hundred several tens ° C. for several minutes through several tens of minutes after the coating.

In addition, the silicon resin that is a material used for the nozzle plate ink repellent process of the liquid jet head of the embodiment of the present invention may be an ultraviolet ray curing type liquid state silicon resin or an elastomer. Because of this, it is possible to form the silicon resin film having durability by irradiating ultraviolet rays of 500 through 1000 $mJ/cm^2$ after the coating.

Thus, in the nozzle member of the liquid jet head of the embodiment of the present invention, the ink repellent layer made of silicon resin is formed at the ink jet surface side and the ink repellent layer has thickness equal to or greater than 0.1 μm, more preferably equal to or greater than 0.5 μm. Thus, since the layer using the silicon resin is evenly and smoothly formed at the ink jet surface side so as to have thickness equal to or greater than 0.1 μm, it is possible to provide the liquid jet nozzle having good durability against wiping or ink repellency. Especially, ink proofing can be improved due to chemical proofing of the silicon resin.

In addition, the surface roughness Ra of the ink repellent layer may be equal to or less than 0.2 μm. Thus, since the surface roughness Ra is equal to or less than 0.2 μm, it is possible to obtain good surface ability and ink residual due to sweeping such as wiping is small.

Furthermore, the silicon resin may be applied on the nozzle plate surface where the nozzle hole is formed in advance by the dispenser.

Thus, since the liquid state silicon resin is applied on the nozzle plate surface where the nozzle hole is formed in advance by the dispenser, it is possible to selectively and efficiently form the ink repellent film having no default, such as a pin hole on the surface of the nozzle plate.

In addition, the viscosity of the silicon resin may be equal to or less than 1000 cp. Thus, since the viscosity of the liquid state silicon is equal to or less than 1000 cp, it is possible to form the ink repellent layer having good surface ability.

Furthermore, in the application by using the dispenser, the silicon resin may be coated while the gas is jetted from the nozzle hole. Thus, since the gas is jetted from the nozzle hole, at the time of coating the liquid state silicon, it is possible to completely prevent entry of the silicon to the nozzle inside wall or to the rear surface.

In addition, where application is by using the dispenser, after the silicon resin is coated on the nozzle plate surface and the silicon penetrates to a desirable depth of the nozzle hole, the gas may be jetted from the nozzle hole. Thus, since the gas is jetted from the nozzle hole after the liquid silicon is coated, it is possible to coat the silicon resin to a desirable depth of the nozzle inside wall.

Furthermore, the silicon resin may be a normal temperature curing type liquid state silicon resin or an elastomer. The silicon resin may be applied on the nozzle plate surface and left at the air in the normal temperature so that polymerizing curing is made and the ink repellent film may be formed.

Thus, since the normal temperature curing type silicon resin or a silicon elastomer is used as a silicon material, the normal temperature curing type silicon resin or the silicon elastomer is cured by simply leaving it in the air at the normal temperature after being coated on the nozzle surface so that the ink repellent film having good durability can be formed.

In addition, the silicon resin may be a heating curing type liquid silicon resin or an elastomer and the silicon resin is applied on the nozzle plate surface and a heating process is applied so as to be cured and the ink repellent film may be formed. Thus, since the heating curing type liquid silicon resin or elastomer is used as the silicon material, the silicon resin is cured in a short period of time by applying a heat treatment after coating the silicon resin on the nozzle surface and the ink repellent film having a good durability can be formed.

Furthermore, the silicon resin may be an ultraviolet ray curing type liquid silicon resin or an elastomer. The silicon resin is applied on the nozzle plate surface and the ultraviolet rays are irradiated so that the silicon resin is cured and the ink repellent film may be formed. Thus, since the ultraviolet ray curing type liquid silicon resin or the silicon elastomer is used as the silicon material, the silicon resin is cured in a short period of time by irradiating the ultraviolet rays after coating the resin on the nozzle surface and the ink repellent film having good durability can be formed.

In addition, the liquid jet recording device of the embodiment of the present invention used the above-mentioned nozzle member. Thus, since the nozzle plate of the embodiment of the present invention is used, a straight line ability of the ink drop is good at the time of ink jetting so that jetting curve can be little.

Furthermore, in the liquid jet recording device of the embodiment of the present invention, the ink to be used has a surface tension equal to or less than 70 mN/m.

Thus, since the ink having a low surface tension can be used, adhesion capability of the ink to the recording medium such as the paper can be improved.

In addition, the ink may contain the fluoride group surface active agent. Thus, since the fluoride group surface active agent is contained in the ink to be used, it is possible to form an image with high coloring.

Furthermore, the ink may contain the pigment. Thus, since the ink contains the pigment, it is possible to form a high quality image having high weathering ability and water resisting ability even on normal paper.

The present invention is not limited to these embodiments, but variations and modifications may be made without departing from the scope of the present invention.

For example, in the above-discussed embodiment, the nozzle plate 202 is made by Ni electroforming. However, as long as the material of the ink repellent film can be applied, various metals such as SUS (Super Use Stainless) or various resins can be used for the nozzle plate 202.

In addition, when the ink repellent film is formed on the surface of the base of the liquid jet head, first the oxide layer on the surface of the base (nozzle plate 2) may be removed and then the material of the ink repellent film may be applied. Alternatively, after an intermediate layer may be formed, the material of the ink repellent film may be applied.

As the intermediate layer (primer), for example, "Primer D" made by Toray Dow Corning Corporation may be used and it is found that good adhesion can be obtained in this case.

In addition, after the ground of the base surface is made rough by Ni strike plating, the material of the ink repellent film may be applied.

INDUSTRIAL APPLICABILITY

The present invention is applied to the liquid jet heads, manufacturing methods of the liquid jet heads, image forming devices, nozzle members of the liquid jet heads, repellent ink film forming methods, cartridges, and liquid jet recording devices.

The invention claimed is:

1. A liquid jet head, comprising:

a nozzle forming member having a water repellent layer formed on a liquid drop jet side surface of a nozzle base having a nozzle hole configured to jet a liquid drop of recording liquid;

wherein the water repellent layer is made of silicon resin; and an oxide layer provided between the liquid drop jet side surface of the nozzle base and the water repellent layer is thinner than an oxide layer provided on a nozzle hole internal wall surface of the nozzle base.

2. The liquid jet head as claimed in claim 1, wherein the nozzle base is made of Ni.

3. The liquid jet head as claimed in claim 1, wherein the recording liquid includes a fluoride chemical compound.

4. The liquid jet head as claimed in claim 1, wherein the recording liquid has a dynamic surface tension equal to or less than 30 mN/m and a ph in the range 8 through 11.

5. The liquid jet head as claimed in claim 1, wherein an elution prevention agent is added into the recording liquid.

6. A manufacturing method of a liquid jet head, the liquid jet head being claimed in claim 1, the manufacturing method comprising the step of:

forming the water repellent layer made of the silicon resin in the nozzle base in the air.

7. The manufacturing method of the liquid jet head as claimed in claim 6, wherein the water repellent layer is formed by applying the silicon resin to the nozzle base by a dispenser in a state where air is blown from an opposite side of the liquid drop jet side surface toward the liquid drop jet side surface side via the nozzle hole of the nozzle base.

8. The manufacturing method of the liquid jet head as claimed in claim 6, wherein the water repellent layer made of the silicon resin is formed on the nozzle base after an acid treatment, a plasma process, or an ultraviolet ray process is applied to the nozzle base so that a surface oxide layer is removed or a hydroxyl group substitution is made.

9. A manufacturing method of a liquid jet head, the liquid jet head being claimed in claim 1, the manufacturing method comprising the step of:

forming the water repellent layer made of the silicon resin on the nozzle base after an acid treatment, a plasma process, or an ultraviolet ray process is applied to the nozzle base so that a surface oxide layer is removed or a hydroxyl group substitution is made.

10. The manufacturing method of the liquid jet head as claimed in claim 9, wherein the water repellent layer is formed by applying a normal temperature curing type liquid state silicon resin.

11. An image forming device, comprising:

a liquid jet head configured to jet a liquid drop of recording liquid, the liquid jet head being claimed in claim 1.

* * * * *